US006613490B2

(12) United States Patent
Matsunaga et al.

(10) Patent No.: US 6,613,490 B2
(45) Date of Patent: Sep. 2, 2003

(54) TONER, IMAGE FORMING METHOD AND PROCESS-CARTRIDGE

(75) Inventors: Satoshi Matsunaga, Mishima (JP); Yuichi Mizoh, Toride (JP); Junko Yoshikawa, Toride (JP); Ryota Kashiwabara, Numazi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/984,118

(22) Filed: Oct. 29, 2001

(65) Prior Publication Data

US 2002/0098433 A1 Jul. 25, 2002

(30) Foreign Application Priority Data

Oct. 31, 2000 (JP) ..... 2000-333335
Nov. 30, 2000 (JP) ..... 2000-364317

(51) Int. Cl.[7] ..... G03G 9/08
(52) U.S. Cl. ..... 430/109.3; 430/111.4
(58) Field of Search ..... 430/108.3, 108.8, 430/110.3, 110.4, 109.3, 111.4

(56) References Cited

U.S. PATENT DOCUMENTS

| | | | | |
|---|---|---|---|---|
| 5,605,778 A | | 2/1997 | Onuma et al. | 430/110 |
| 5,721,433 A | | 2/1998 | Kosaka | 250/573 |
| 5,912,101 A | | 6/1999 | Karaki et al. | 430/110 |
| 5,952,138 A | | 9/1999 | Kuwashima et al. | 430/39 |
| 5,976,752 A | * | 11/1999 | Matsunaga et al. | 430/109.3 |
| 6,033,817 A | | 3/2000 | Yusa et al. | 430/106.6 |
| 6,040,103 A | | 3/2000 | Ohno et al. | 430/110 |

FOREIGN PATENT DOCUMENTS

| | | |
|---|---|---|
| JP | 57-171345 | 10/1982 |
| JP | 61-279864 | 12/1986 |
| JP | 62-195681 | 8/1987 |
| JP | 63-235953 | 9/1988 |
| JP | 8-136439 | 5/1996 |
| JP | 9-146292 | 6/1997 |
| JP | 9-244294 | 9/1997 |
| JP | 10-97095 | 4/1998 |
| JP | 11-149175 | 6/1999 |
| JP | 11-153885 | 6/1999 |
| JP | 11-202557 | 7/1999 |
| JP | 2000-47428 | 2/2000 |
| JP | 2000-47429 | 2/2000 |
| JP | 2000-47430 | 2/2000 |
| JP | 2000-56511 | 2/2000 |
| JP | 2000-284531 | 10/2000 |

* cited by examiner

*Primary Examiner*—John Goodrow
(74) *Attorney, Agent, or Firm*—Fitzpatrick, Cella, Harper & Scinto

(57) ABSTRACT

A toner exhibiting good balance of low-temperature fixability, an anti-offset characteristic and a developing performance in continuous image formation is formed of at least a binder resin, a colorant and a wax. The toner exhibits a dielectric loss tangent showing a maximum of $6.0\times10^{-2}$ to $10.0\times10^{-2}$ in a temperature range of 90 to 125° C. The toner provides a DSC curve showing at least one heat-absorption peak or shoulder in a temperature range of 85 to 140° C. on temperature increase according to differential scanning calorimetry (DSC). The binder resin comprises a hybrid resin having a vinyl polymer unit and a polyester unit.

24 Claims, 12 Drawing Sheets

TONER, IMAGE FORMING METHOD AND PROCESS-CARTRIDGE

FIELD OF THE INVENTION AND RELATED ART

The present invention relates to a toner for use in a recording method utilizing electrophotography, electrostatic recording, electrostatic printing or toner jetting; and also an image forming method and a process-cartridge using the toner.

In electrophotographic process in general, an electrostatic latent image is formed on a photosensitive member by various means and developed with a toner to form a toner image. The toner image is then transferred onto a transfer (-receiving) material such as paper, as desired, and then fixed, e.g., by heating, pressing or heating and pressing, or with solvent vapor, to obtain a fixed toner image.

Regarding the final step of fixing the toner image onto a sheet (fixation sheet) of, e.g., paper, various methods and apparatus have been developed, and the currently most popular systems adopt a pressure-heating scheme using hot rollers or a fixed heat-generating heater via a heating film.

In the pressure-heating scheme using hot rollers, a fixation sheet carrying a toner image is caused to pass through a heating roller while the heating roller surface and the fixation sheet surface carrying the toner image are caused to contact each other, thereby fixing the toner image onto the fixation sheet. In this method, the heating roller surface and the toner image on the fixation sheet are caused to contact each other under pressure, the heat efficiency for melt-bonding the toner image onto the fixation sheet is very good, thereby allowing quick fixation.

However, as the toner image in a softened and melted state is caused to contact the heating roller surface under pressure, a portion of the toner image can be attached and transferred onto the heating or fixing roller surface and re-transferred to a subsequent fixation sheet to soil the subsequent fixation sheet. This is called an offset phenomenon. The offset phenomenon is largely affected by the fixing speed and the fixing temperature. Generally, in the case of a slow fixing speed, the heating (i.e., fixing) roller surface temperature is set to be relatively low, and in the case of a fast fixing speed, the heating roller surface temperature is set to be relatively high. This setting change is adopted in order to supply a constant amount of heat for fixation to a toner image regardless of the fixing speed.

A toner image on a fixation sheet is composed of a number of toner particle layers. As a result, in the case of a high fixing speed requiring a higher heating roller surface temperature, a large temperature difference occurs between the uppermost toner particle layer directly contacting the heating roller and the lowermost toner particle layer contacting the fixation sheet. A higher heating roller surface temperature is liable to excessively soften and melt the uppermost toner particle layer to result in an offset phenomenon. On the other hand, a lower heating roller surface temperature is liable to fail in sufficiently melting the lowermost toner particle layer for fixation and cause a fixation failure of the toner onto the fixations sheet, thus resulting in a so-called low-temperature offset phenomenon.

For solving the above-mentioned difficulties, it has been generally practiced to increase the fixing pressure in the case of a high fixing speed, thereby anchoring the toner onto the fixation sheet. By this measure, the heating roller temperature can be lowered to some extent, thereby alleviating the high-temperature offset phenomenon. In this case however, a very large shearing force is applied to the toner layer, thereby causing difficulties, such as winding offset of the fixation sheet being wound about the fixing (i.e., heating) roller, and separation claw traces (in the fixed toner image) due to action of separation claws for separating the fixation sheet from the fixing roller. Further, because of a high fixing pressure, e.g., line images are liable to be collapsed or a portion of the toner image is scattered to deteriorate the fixed toner images.

Hitherto, the improvement in toner offset phenomenon and the improvement in toner fixability have been regarded as an identical problem, but the conventional solution therefor by an improvement in molecular weight distribution of toner binder resin and the addition of a low-melting point wax can result in only limited and insufficient levels of improvements in fixability and anti-offset property.

Other trials of improving the releasability of a fixing member and a cleaning member may be effective for achieving a sufficient offset-preventing performance in an initial stage of use but can consequently result in offset phenomenon in a long period of use due to deterioration with time of the members if the releasability of the toner per se is insufficient.

For impart a toner with a releasability, the toner is caused to contain a wax in some cases, but a large amount of wax has to be contained for maintaining a sufficient offset-preventing effect even by using a fixing member and a cleaning member which have been deteriorated with time. In such a case, the toner is liable to suffer from difficulties with its developing performance, such as a lowering in image density and an increase in fog density, and it becomes difficult to control the dispersion state of a wax contained in toner particles, so that the toner is liable to contain a large amount of isolated wax, which is liable to result in toner cleaning failure on the photosensitive member leading to image defects.

More specifically, waxes are added in the toner production stage in order to improve the toner releasability and fixability, but the uniform dispersion of waxes in toner particles is not so easy, and insufficient dispersion of wax is liable to result in problems not only in toner fixability but also in developing performance of the toner. These problems are particularly noticeable in recent development of toners of which the particle size is becoming smaller in recent years.

Regarding proposals in recent years, JP-A 6-118700 has disclosed a toner having tan δ values at room temperature and a high temperature giving a ratio falling within a specific range so as to suppress a lowering in chargeability in a high temperature region, but the dispersibility of a wax in toner particles has not been improved.

JP-A 61-279864 has disclosed a toner having specified shape factors SF-1 and SF-2, and JP-A 63-235953 has disclosed a toner made spherical by application of a mechanical impact force, but the improvements in toner transferability and fixability are insufficient.

JP-A 10-97095 and JP-A 11-202557 have disclosed toners having specific circularity values in order to provide a toner with an improved transferability. JP-A 11-149175 has disclosed a toner surface-treated by application of a mechanical impact force in order to provide improvements in toner transferability, scattering at the time of fixation, etc. These toners have been improved in transferability but have left room for improvement regarding uniform wax dispersion in toner particles.

JP-A 57-171345 has disclosed a developer containing as a binder a copolymer of styrene monomer, (meth)acrylic monomer and unsaturated polyester resin. JP-A 62-195681 has disclosed a developer containing as a principal binder component a polyester resin which contains a specific proportion of vinyl resin having a specific molecular weight and a glass transition temperature. These developers have not been sufficiently improved with respect to fixability and wax dispersibility.

JP-A 11-153885 has disclosed a toner containing a binder resin obtained by reaction between a polyester resin having a specific molecular weight and a vinyl polymer having a specific structure, but the fixability and wax dispersibility have not been sufficiently improved.

JP-A 2000-56511 has disclosed a toner containing a binder resin which contains a hybrid resin component, a specific proportion of insoluble matter within a specific solvent and a tetrahydrofuran-soluble content having a specific molecular weight distribution, but the toner has left a room for improvement regarding the image forming performance in a high temperature/high humidity environment.

JP-A 9-146292 has disclosed a toner containing polyalkylene fine particles having a specific dynamic friction coefficient and providing a fixed toner image showing a specific range of contact angle, and JP-A 9-244294 has disclosed a toner containing specific polyalkylene fine particles having a specific dynamic friction coefficient and having a specific relationship between contact angle and dielectric loss tangent of toner, in order to improve the fixability and fog. The transferability and wax dispersibility of the toners have not been improved, and the improvement in fixability is insufficient.

JP-A 2000-47428, JP-A 2000-47429 and JP-A 2000-47430 have disclosed a toner having specific contact angles in order to improve the toner fixability and reduce the toner attachment onto the fixing member, but the improvement in transferability of the toner is not sufficient.

JP-A 2000-284531 has disclosed a toner having a specific dielectric loss tangent and containing an organic zirconium compound as a charge control agent, but the improvement in transferability of the toner is not sufficient.

SUMMARY OF THE INVENTION

An object of the present invention is to provide a toner containing a wax in a good dispersion state within toner particles and excellent in low-temperature fixability and anti-high-temperature offset characteristic.

Another object of the present invention is to provide a toner giving a stable image density in normal temperature/normal humidity and high temperature/high humidity environments, when used in a medium- to high-speed image forming apparatus including a hot roller fixing device or a medium- to low-speed image forming apparatus including a pressure-fixing means comprising a fixed exothermic heater for heating via a heat-resistant film.

Another object of the present invention is to provide a toner comprising toner particles containing a wax in a well-dispersed state and showing improved anti-toner attachment and anti-offset characteristic even with fixing members which have been deteriorated with time.

Further objects of the present invention are to provide an image forming apparatus and a process-cartridge including such a toner as described above.

According to the present invention, there is provided a toner comprising: at least a binder resin, a colorant and a wax, wherein (a) the toner exhibits a dielectric loss tangent showing a maximum of $6.0\times10^{-2}$ to $10.0\times10^{-2}$ in a temperature range of 90 to 125° C., (b) the toner provides a DSC curve showing at least one heat-absorption peak or shoulder in a temperature range of 85 to 140° C. on temperature increase according to differential scanning calorimetry (DSC), and (c) the binder resin comprises a hybrid resin having a vinyl polymer unit and a polyester unit.

According to the present invention, there is also provided an image forming apparatus, comprising:

(I) a developing step of developing an electrostatic image carried on an image-bearing member with the above-mentioned toner to form a toner image;

(II) a transfer step of transferring the toner image on the image-bearing member onto a recording material via or without via an intermediate transfer member; and (III) a fixing step of heat-fixing the toner image onto the recording material.

The present invention also provides a process-cartridge detachably mountable to a main assembly of an image forming apparatus for forming a toner image by developing an electrostatic latent image formed on an image-bearing member, wherein said process-cartridge includes (i) an image-bearing member, (ii) a developing means for developing an electrostatic latent image carried on the image-bearing member with the above-mentioned toner to form a toner image on the image-bearing member, and (iii) at least one means selected from the group consisting of a charging means for charging the image-bearing member, a latent image-forming means for forming the electrostatic latent image on the image-bearing member, a transfer means for transferring the toner image onto a recording material, and a cleaning means for removing a portion of toner remaining on the image-bearing member after transfer of the toner image onto the recording material.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
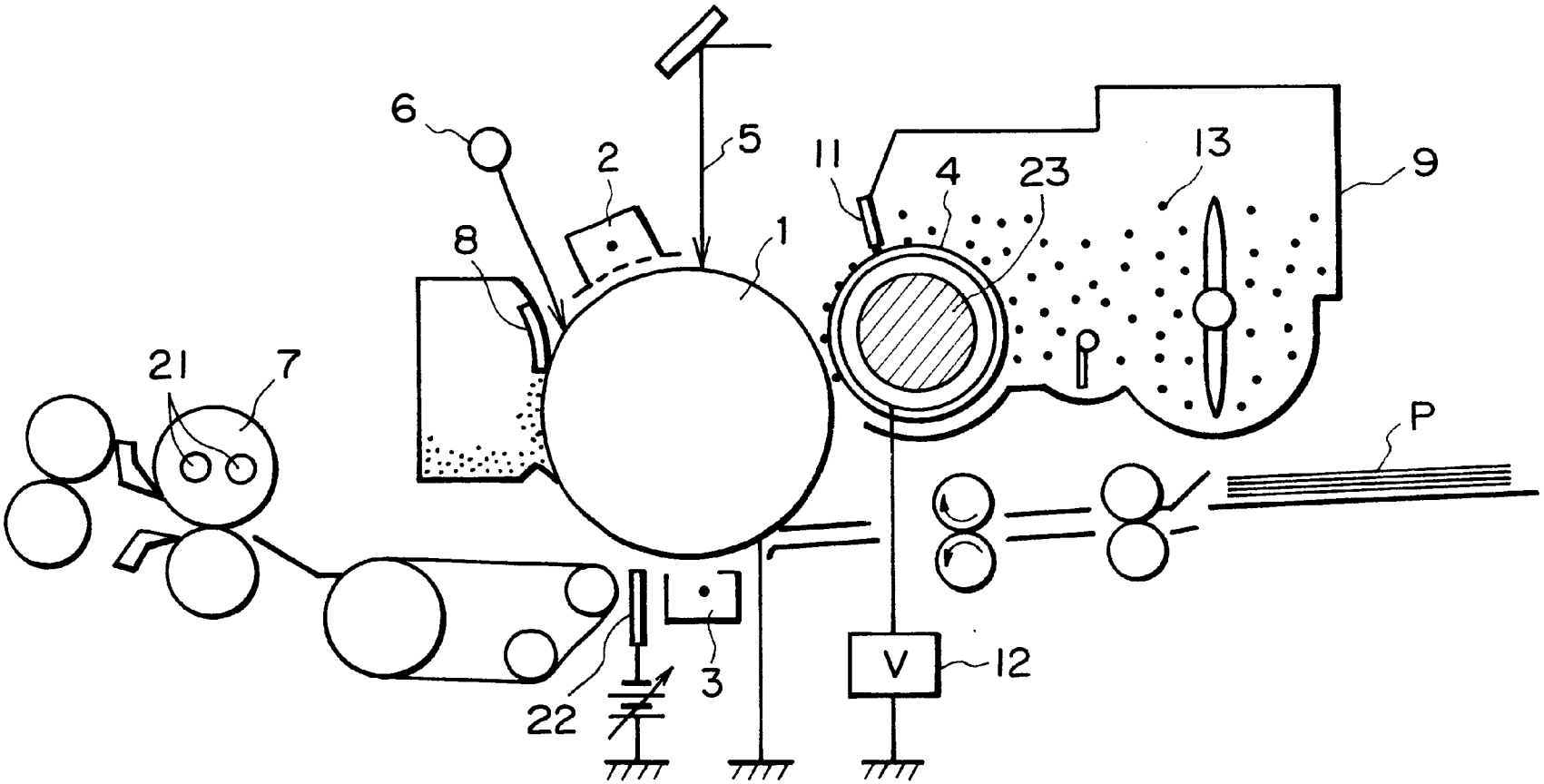
FIGS. 1 and 3 respectively illustrate an example of image forming apparatus suitable for practicing an embodiment of the image forming method of the invention.

It has been discovered by us that a toner comprising a hybrid resin as a binder resin and satisfying specific dielectric and heat-absorption characteristics is effective for improving the developing performance, transferability and fog resistance and also for improving the resistance to toner attachment and offsetting onto fixing members which have been deteriorated with time due to continual use.

More specifically, the toner of the present invention exhibits a dielectric loss tangent as measured at a frequency of 100 kHz showing a maximum of $6.0\times10^{-2}$ to $10.0\times10^{-2}$, preferably $6.5\times10^{-2}$ to $9.0\times10^{-2}$, further preferably $6.9\times10^{-2}$ to $8.0\times10^{-2}$, in a temperature range of 90 to 125° C.

In a toner containing a binder resin comprising a hybrid resin, the binder resin is liable to contain a large amount of THF (tetrahydrofuran)-insoluble matter, so that the dispersion of additives, such as a magnetic material and a wax becomes difficult. However, if such a toner is composed to have a dielectric loss tangent measured at a frequency of 100 kHz showing a maximum in a temperature range of 90–125° C., and the maximum is in the range of $6.0\times10^{-2}$ to $10.0\times10^{-2}$, a good dispersion of the additives can be accomplished.

In any of the case where the dielectric loss tangent has no maximum in the temperature range of 90 to 125° C., the case where the maximum exceeds $10.0\times10^{-2}$ and the case where the maximum is below $6.0\times10^{-2}$, the developing performance becomes inferior, particularly the image density after standing in a high temperature/high humidity environment is remarkably lowered, and the image stability during a continuous image formation is liable to be inferior, as represented by a lowering in image density, not only in the high temperature/high humidity environment.

The values of dielectric loss tangent of a toner principally depend on the binder resin composition but are also affected by the surface characteristic and components present at the surface of the toner (particles). Accordingly, the dielectric loss tangent values can be controlled by selection of the binder resin and wax and can also be controlled by selection of toner production conditions.

The effects of the present invention become particularly pronounced especially when the toner has a specific circularity. More specifically, it is preferred that the toner of the present invention contains toner particles of 3 $\mu$m or larger including at least 70% by number of particles having a circularity (Ci)≧0.950. It is further preferred that the particles having Ci≧0.950 occupy 70–95% by number, more preferably 75–93% by number, particularly preferably 70–90% by number, of the toner particles of 3 $\mu$m or larger. In the case where the particles of Ci≧0.950 are less than 70%, the toner is liable to have insufficient transferability and exhibit inferior fixability and developing performance because of an increase in total specific surface area and increased probability of liberation of magnetic material, wax, etc. from the toner particles. Also in this case, it becomes difficult to control the dielectric loss tangent. On the other hand, in the case where the particles of Ci≧0.950 exceed 95%, the toner is liable to be excessively charged in the low humidity environment, and the control of dielectric loss tangent of the toner is liable to be difficult.

The toner according to the present invention may preferably have an acid value (Av) of 1 to 30 mgKOH/g, more preferably 5 to 25 mgKOH/g, further preferably 7–20 mgKOH/g. If the acid value is below 1 mgKOH/g or above 30 mgKOH/g, the image density is liable to be lowered during image formation in a high temperature/high humidity environment, and the image density stability is liable to become inferior due to a lowering in image density also in a continuous image formation.

The binder resin of the toner according to the present invention may preferably contain 5 to 60 wt. %, more preferably 10 to 50 wt. %, further preferably 15 to 40 wt. %, of THF-insoluble matter. If the THF-insoluble matter content is below 5 wt. % of the binder resin or above 60 wt. %, it becomes difficult to provide a good combination of low-temperature fixability and anti high-temperature offset characteristic.

The binder resin of the toner according to the present invention comprises a hybrid resin having a polyester unit and a vinyl polymer and may preferably comprise at least 50 wt. %, more preferably at least 55 wt. %, further preferably at least 60 wt. %, of such a hybrid resin. The remainder of the binder resin may include a vinyl polymer and/or a polyester as a precursor of the hybrid resin, and another optionally added polymer.

The THF-soluble content of the binder resin may principally have a molecular weight distribution as measured by GPC (gel permeation chromatography) showing a main peak, i.e., a peak molecular weight (Mp), in a molecular weight region of 3,000 to 15,000, a ratio (Mz/Mw) of 30 to 1,000 between a Z-average molecular weight (Mz) and a weight-average molecular weight (Mw); more preferably Mp in a molecular weight region of 5,000 to 12,000 and a ratio (Mz/Mw) of 50 to 700; further preferably Mp in a region of 6,000 to 10,000 and a ratio (Mz/Mw) of 100 to 500. If Mp is outside the molecular weight region of 3,000 to 15,000, it becomes difficult to provide a good combination of low-temperature fixability and anti-high-temperature offset characteristic even if the ratio (Mz/Mw) is in the range of 30 to 1,000. On the other hand, if the ratio (Mz/Mw) is below 30 or above 1000, it becomes difficult to provide a good combination of low-temperature fixability and anti-high-temperature offset characteristic, even if Mp is in the molecular weight region of 3,000 to 15,000.

The presence of a hybrid resin in a binder resin can be confirmed according to $^{13}$C-NMR measurement by a signal attributable to a carboxyl group appearing at a position (of e.g., ca. 168 ppm) different from positions (of, e.g., ca. 172 ppm and ca. 174 ppm) of signals attributable to carboxyl groups constituting esters or carboxylic acids constituting polyesters or a position (of ca. 176 ppm) of a signal attributable to a carboxyl group of (meth)acrylate ester constituting a vinyl polymer. A non-magnetic toner sample can be subjected to the $^{13}$C-NMR measurement as it is. In the case of a magnetic toner, however, it is appropriate to remove the magnetic material from the toner, e.g., by stirring the toner with a conc. hydrochloric acid aqueous solution for 70 to 80 hours at room temperature, and subject the remaining resin sample to $^{13}$C-NMR measurement, since the magnetic material can obstruct the resolving power of $^{13}$C-NMR.

Some examples of $^{13}$C-NMR spectra are shown in Table 1 below.

TABLE 1

Identification of carboxyl group signal in $^{13}$C-NMR

| Position | ca. 168*3 ppm | ca. 172*1 ppm | ca. 174*1 ppm | ca. 176*2 ppm |
|---|---|---|---|---|
| Polyester | — | ○ | ○ | — |
| Vinyl polymer | — | — | — | ○ |
| Hybrid** resin | ○ | ○ | ○ | ○ |

**A binder resin obtained through a process giving a hybrid resin as described hereinafter.
*1Signals attributable to carboxyl groups pf aliphatic dicarboxylic acids giving a polyester.
*2A signal attributable to a carboxyl group of an acrylate ester giving a vinyl polymer.
*3A newly found signal attributable to a carboxyl group in a hybrid resin.

The polyester (unit constituting or) used for providing the hybrid resin as a binder resin (component) may be produced from monomers as described below.

Diols, such as ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, bisphenols and derivatives represented by the following formula (2) and diols represented by a formula (3) below:

(2)

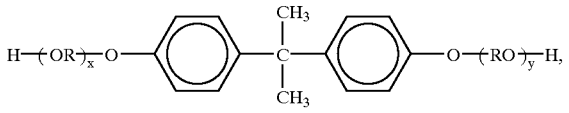

wherein R denotes an ethylene or propylene group, x and y are independently an integer of at least 1 with the proviso that the average of x+y is in the range of 2–10;

(7-2)

(3)

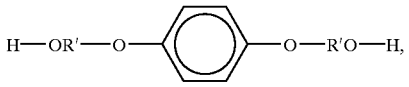

wherein R' denotes an ethylene, propylene or tert-butylene group.

Examples of acid components may include benzenedicarboxylic acids, such as phthalic acid, isophthalic acid and terephthalic acid, and their anhydrides; alkyldicarboxylic acids, such as succinic acid, adipic acid, sebacic acid and azelaic acid, and their anhydrides; $C_6$–$C_{18}$ alkyl- or alkenyl-substituted succinic acids, and their anhydrides; and unsaturated dicarboxylic acids, such as fumaric acid, maleic acid, citraconic acid and itaconic acid, and their anhydrides.

The polyester used for providing the hybrid resin may preferably comprise a mixture of a saturated polyester and an unsaturated polyester in a weight ratio of 50:1 to 1:1, more preferably 30:1 to 3:1, further preferably 20:1 to 5:1. If the ratio exceeds 50:1 and the unsaturated polyester amount is below the range, the addition polymerization with a vinyl polymer is liable to be insufficient to result in a toner having an insufficient anti-high-temperature offset characteristic. On the other hand, if the ratio is below 1:1 so that an unsaturated polyester is used excessively, the resultant toner is liable to have inferior low-temperature fixability.

Regardless of whether it is saturated or unsaturated, the polyester constituting the hybrid resin may preferably have a hydroxyl value (OHv) of 10 to 70 mgKOH/g and a ratio (Av/OHv) of 0.1 to 2 between the acid value (Av) and the hydroxyl value (OHv); more preferably OHv=15 to 60 mgKOH/g and Av/OHv=0.5 to 1.5; particularly preferably OHv=20 to 50 mgKOH/g and Av/OHv=0.7 to 1.2. If OHv is below 10 mgKOH/g, the esterification with the vinyl polymer is liable to be insufficient to result in a toner having an insufficient anti-high-temperature offset characteristic. If OHv is above 70 mgKOH/g, the esterification with the vinyl polymer is liable to be excessive to result in a toner having an inferior low-temperature fixability.

Regardless of being saturated or unsaturated, the polyester constituting the hybrid resin may preferably have a weight-average molecular weight (Mw) of 2,000 to 50,000 and a ratio (Mw/Mn) of 2 to 20 between Mw and number-average molecular weight (Mn); more preferably Mw=3,000 to 20,000 and Mw/Mn=2.5 to 1; particularly preferably Mw=5,000 to 15,000 and Mw/Mn=2.7 to 5. If Mw is below 2,000 and Mw/Mn is below 2 or above 20, the resultant toner is liable to have an insufficient anti-high-temperature offset characteristic. On the other hand, if Mw exceeds 10,000 and Mw/Mn is below 2 or above 10, the resultant toner is liable to have an inferior low-temperature fixability.

The vinyl polymer (unit constituting or) used for providing the hybrid resin may preferably comprise a copolymer of styrene monomer and another vinyl monomer, examples of which may include: styrene derivatives, such as vinyltoluene; acrylic acid; acrylates, such as methyl acrylate, ethyl acrylate, butyl acrylate, dodecyl acrylate, octyl acrylate, 2-ethylhexyl acrylate, and phenyl acrylate; methacrylic acid; methacrylates, such as methyl methacrylate, ethyl methacrylate, butyl methacrylate, dodecyl methacrylate, octyl methacrylate, 2-ethylhexyl methacrylate and phenyl methacrylate; unsaturated dicarboxylic acids and mono- or di-esters thereof, such as maleic acid, maleic anhydride monobutyl maleate, methyl maleate and dimethyl maleate; acrylamide, methacrylamide, acrylonitrile, methacrylonitrile; butadiene; vinyl chloride, vinyl acetate, vinyl benzoate; ethylene olefins, such as ethylene, propylene and butylene; vinyl ketones, such as vinyl methyl ketone and vinyl hexyl ketone; and vinyl ethers, such as vinyl methyl ether, vinyl ethyl ether and vinyl isobutyl ether. These vinyl monomers may be used singly or in mixture of two or more species.

The vinyl polymer (unit) used for constituting the hybrid resin may be produced by using a polymerization initiator, examples of which may include: 2,2'-azobisisobutyronitrile, 2,2'-azobis(4-methoxy-2,4-dimethylvaleronitrile), 2,2'-azobis(2,4-dimethyl-valeronitrile), 2,2'-azobis(2-methylbutylonitrile), dimethyl-2,2'-azobisisobutyrate, 1,1'-azobis(l-cyclohexanecarbonitrile), 2-(carbamoylazo)-isobutyronitrile, 2,2'-azobis(2,4,4-trimethylpentane), 2-phenylazo-2,4-dimethyl-4-methoxyvaleronitrile, 2,2'-azobis(2-methylpropane); ketone peroxides, such as methyl ethyl ketone peroxide, acetylacetone peroxide, and cyclohexanone, peroxide; 2,2-bis(t-butylperoxy)-butane, t-butylhydroperoxide, cumene hydroperoxide, 1,1,3,3-tetramethylbutyl hydroperoxide, di-tert-butyl peroxide, t-butyl cumyl peroxide, dicumyl peroxide, α,α'-bis(t-butylperoxyisopropyl)benzene, isobutyl peroxide, octanoyl peroxide, decanoyl peroxide, lauroyl peroxide, 3,5,5-trimethylhexanoyl peroxide, benzoyl peroxide, m-trioyl peroxide, diisopropyl peroxydicarbonate, di-2-ethylhexyl peroxydicarbonate, di-n-propyl peroxydicarbonate, di-2-ethoxyethyl peroxydicarbonate, di-methoxyisopropyl peroxydicarbonate, di(3-methyl-3-methoxybutyl) peroxycarbonate, acetylcyclohexylsulfonyl peroxide, t-butyl peroxyacetate, t-butyl peroxyisobutyrate, t-butyl peroxyneodecanoate, t-butyl peroxy-2-ethylhexanoate, t-butyl peroxylaurate, t-butyl peroxybenzoate, t-butyl peroxyisopropylcarbonate, di-t-butyl peroxyisophthalate, t-butyl peroxyallyl-carbonate, t-amyl peroxy-2-ethylhexanoate, di-t-butyl peroxyhexahydroterephthalate, and di-t-butyl peroxyazelate.

In the present invention, it is preferred that the vinyl polymer unit and/or the polyester unit components contain a monomer component reactive with these polymer units. Examples of such a monomer component constituting the polyester resin and reactive with the vinyl polymer unit may include: unsaturated dicarboxylic acids, such as fumaric acid, maleic acid, citraconic acid and itaconic acid, and anhydrides thereof. Examples of such a monomer component constituting the vinyl polymer unit and reactive with the polyester unit may include: carboxyl group-containing or hydroxyl group-containing monomers, and (meth)acrylate esters.

In order to obtain a binder resin mixture containing a vinyl polymer, a polyester and a hybrid resin (i.e., a reaction product between the vinyl polymer and the polyester), it is preferred to effect a polymerization reaction for providing one or both of the vinyl polymer and the polyester in the presence of a polymer formed from a monomer mixture including a monomer component reactive with the vinyl polymer and the polyester as described above.

The hybrid resin used as a principal component in the binder resin of the toner according to the present invention may preferably comprise a polyester unit and a vinyl polymer unit bonded to each other in a weight ratio of 20:80 to 70:30, more preferably 40:60 to 50:50. If the polyester unit content in the hybrid resin is below 20 wt. % or above 70 wt. %, it becomes difficult to obtain a good combination of a low-temperature-fixability and a high-temperature-offset characteristic.

A resin composition comprising such a hybrid resin, a vinyl copolymer and a polyester resin and is suitable for use a principal constituent of the binder resin of the toner according to the present invention may for example be produced according to the following methods (1) to (6).

(1) A vinyl polymer is first produced, and in the presence thereof, a polyester and a hybrid resin component are produced. The hybrid resin may be produced through a reaction of the vinyl polymer (and a vinyl monomer optionally added) with polyester monomers (such as an alcohol and a carboxylic acid) and/or a polyester. In this case, an organic solvent may be used as desired. During the production, a wax may preferably be added in this step.

(2) A polyester is first produced, and in the presence thereof, a vinyl polymer and a hybrid resin are produced. The hybrid resin may be produced through the reaction of the polyester (and polyester monomers optionally added) with vinyl monomers and/or a vinyl polymer. A wax may preferably be added in this step.

(3) A vinyl polymer and a polyester are first produced, and in the presence of these polymers, vinyl monomers and/or polyester monomers (alcohol and carboxylic acid) are added thereto for polymerization and transesterification. Also in this instance, an organic solvent may be used as desired. A wax may preferably be added in this step.

(4) A hybrid resin is first prepared, and then vinyl monomers and/or polyester monomers are added to effect addition polymerization and/or polycondensation. In this instance, the hybrid resin may be one prepared in the methods of (1)–(3), or may be one produced through a known process. An organic solvent may be added as desired. A wax may preferably be added in this step.

(5) A vinyl polymer, a polyester and a hybrid resin are separately formed and then blended. The blending may be performed by dissolving or swelling the polymers in an organic solvent, such as xylene, followed by distilling-off of the solvent. Preferably, a wax may be added in the blending step. The hybrid resin may be produced as a copolymer by dissolving or swelling a vinyl polymer and a polyester prepared separately in advance in a small amount of an organic solvent, followed by addition of an esterification catalyst and an alcohol and heating to effect transesterification. The hybrid resin may also be produced through any of the above-mentioned methods (1)–(3).

(6) Vinyl monomers and polyester monomers (alcohol and carboxylic acid) are mixed to effect addition polymerization and polycondensation successively to provide a vinyl polymer, a polyester and a hybrid resin. An organic solvent may be added as desired. A wax may preferably be added in this step.

In the above methods (1)–(5), the vinyl polymer and/or the polyester may respectively comprise a plurality of polymers having different molecular weights and crosslinking degrees.

In the above-described methods (1)–(6), the method (2) may be preferred because of easy molecular weight control of the vinyl polymer (unit), controllability of formation of the hybrid resin and control of the wax dispersion state, if the wax is added at that time.

The binder resin of the toner according to the present invention may principally comprise the hybrid resin and the above-mentioned vinyl polymer and/or polyester as precursor(s) of the hybrid resin but can further contain another polymer, examples of which may include: vinyl polymers in a sense of including vinyl copolymers, polyester resins, polyol resins, phenolic resins, natural resin-modified phenolic resin, natural resin-modified maleic acid resin acrylic resin, methacrylic resin, polyvinyl acetate resin, silicone resin, polyurethane resin, furan resin, epoxy resin, xylene resin, polyvinyl butyral resin, terpene resin, coumarone-indene resin, and petroleum resin. Among these, vinyl polymers (e.g., copolymers of styrene and (meth) acrylate ester) and polyester resins are preferred, and they can be of the same or different species as the vinyl polymer and/or the polymer as the precursor(s) of the hybrid resin.

The toner according to the present invention contains a wax and, as a result, may preferably provide a DSC heat absorption curve obtained by use of a differential scanning calorimeter (DSC) exhibiting a heat absorption peak or shoulder in a temperature range of 85–140° C., more preferably 90–135° C., further preferably 95–130° C. If no peak or shoulder of heat absorption is present in the temperature range of 85–140° C., toner is liable to attach to the fixing member, thus resulting in noticeable fog.

The wax contained in the toner of the present invention may preferably have a molecular weight distribution according to GPC showing a main peak molecular weight (Mp) of 300–20000 and a ratio (Mw/Mn) of 1.0 to 20, more preferably Mp=500–15000 and Mw/Mn=1.1–18, further preferably Mp=700–10000 and Mw/Mn=1.2 to 15. If Mp is below 300, the wax dispersion particle size in toner particles is liable to be excessively small. If Mp is above 20000 or Mw/Mn is above 20, the wax dispersion particle size is liable to become excessively large. In any of the above cases, the control of wax dispersion particle size becomes difficult so that it is difficult to achieve a good dispersion state of wax in the toner particles.

The wax contained in the toner of the present invention may preferably comprise: hydrocarbon wax, polyethylene wax, polypropylene wax, hydroxyl group- or carboxyl group-containing wax, or a modified wax obtained by modifying such a wax with a vinyl monomer.

The hydrocarbon wax preferably used in the present invention may preferably comprise synthetic hydrocarbon wax obtained from distillation residue of hydrocarbons synthesized from carbon monoxide and hydrogen by the Arge process, or from a hydrogenation product of the distillation residue. Such hydrocarbon wax may be further subjected to factionation before use, e.g., by press-sweating, solvent factionation, or precipitation.

The hydroxyl group- or carboxyl group-containing wax may be one represented by the following formula (1):

$$CH_3—(CH_2—CH_2)_a—CH_2—CH_2—A \quad (1),$$

wherein A denotes a hydroxyl group or a carboxyl group, and a denotes an integer of 20–60.

The wax used in the present invention may more preferably be a wax modified with a vinyl monomer or an acid group-containing monomer, further preferably be a hydrocarbon wax modified with such a vinyl monomer or an acid group-containing monomer. It is particularly preferred to use a hydrocarbon wax modified with an aromatic vinyl monomer, or a polyethylene wax modified with a maleic acid monoester or maleic anhydride. Such a wax may preferably be added to a binder resin during a process or step for producing a binder resin composition including the hybrid resin. The wax dispersion can be improved by modification with a vinyl monomer. In the case where the wax dispersion state is excellent, the melt viscosity of a toner composition in the melt-kneading step for toner production can be retained at a level suitable for dispersion of additives, inclusive of a magnetic material or a colorant; thereby improving the dispersion of the additives. As a result, it becomes possible to suppress the occurrence of isolated wax or isolated magnetic material, etc., thereby facilitating the control of the dielectric loss tangent of the toner in the range prescribed by the present invention.

Examples of such a monomer usable for the wax modification may include: styrene; styrene derivatives, such as vinyltoluene; acrylic acid; acrylates, such as methyl acrylate, ethyl acrylate, butyl acrylate, dodecyl acrylate, octyl acrylate, 2-ethylhexyl acrylate, and phenyl acrylate; methacrylic acid; methacrylates, such as methyl methacrylate, ethyl methacrylate, butyl methacrylate, dodecyl methacrylate, octyl methacrylate, 2-ethylhexyl methacrylate and phenyl methacrylate; unsaturated dicarboxylic acids and mono- or di-esters thereof, such as maleic acid, maleic anhydride monobutyl maleate, methyl maleate and dimethyl maleate; acrylamide, methacrylamide, acrylonitrile, methacrylonitrile; butadiene; vinyl chloride, vinyl acetate, vinyl benzoate; ethylene olefins, such as ethylene, propylene and butylene; vinyl ketones, such as vinyl methyl ketone and vinyl hexyl ketone; and vinyl ethers, such as vinyl methyl ether, vinyl ethyl ether and vinyl isobutyl ether. These vinyl monomers may be used singly or in mixture of two or more species. It is further preferred to use styrene monomer, or monobutyl maleate or maleic anhydride as a wax-modifying monomer, so as to uniformize the wax dispersion in the toner particles and provide the resultant toner with improved flowability, storability and low-temperature fixability.

It is also possible to use an unsaturated polyester for modification of the wax together with the above-mentioned wax-modifying monomer. Such an unsaturated polyester may be formed from diols and dicarboxylic acids similar to those described above for producing the polyester as a hybrid resin precursor except for including an unsaturated diol or dicarboxylic acid component. It is preferred to include an unsaturated dicarboxylic acid, preferred examples of which are fumaric acid, maleic acid and maleic anhydride. These unsaturated dicarboxylic acids can also be included as esters.

It is preferred to use a modified wax obtained by modifying a base wax with a specific amount of wax-modifying monomer.

For example, it is preferred to use a styrene-modified wax obtained by modifying 100 wt. parts of a base wax with 10–100 wt. parts, more preferably 20–80 wt. parts, further preferably 30–50 wt. parts, of styrene.

It is also preferred to use a modified wax obtained by modifying 100 wt. parts of a base wax with 5–40 wt. parts, more preferably 7–30 wt. parts, further preferably 10–25 wt. parts, of monobutyl maleate or maleic anhydride.

Another preferred modified wax may be obtained by modifying 100 wt. parts of a base wax with the above-mentioned range of styrene together with 2–20 wt. parts, more preferably 5–10 wt. parts, of monobutyl maleate.

Another preferred modified wax may be obtained by modifying 100 wt. parts of a base wax with the above-mentioned ranges of styrene and mono-butyl maleate together with 10–100 wt. parts, more preferably 20–80 wt. parts, further preferably 30–50 wt. parts, of an unsaturated polyester.

In the toner of the present invention, the wax may preferably be added in an amount of 1–20 wt. parts, more preferably 3–10 wt. parts, per 100 wt. parts of the binder resin.

The above-mentioned modification of a wax with a monomer may be performed in the presence of a polymerization initiator, which may for example be selected from the above-mentioned class of polymerization initiators for producing the vinyl polymer as a hybrid resin precursor.

For effectively performing the wax modification, it is particularly preferred to use a peroxide polymerizations initiator, preferred examples of which may include: 1,1-di-(t-butylperoxy)-3,3,5-trimethylcyclohexane and di-cinnamoyl peroxide.

The wax can be added to the toner-forming composition in the melt-kneading step for the toner production, but it is preferred to add the wax in the binder resin-production step for facilitating uniform wax dispersion.

In the process for production of the toner of the present invention, it is possible to add a yet-unmodified wax prior to the vinyl polymer production step and modify the wax simultaneously in the vinyl polymerization step.

The toner of the present invention may preferably have a weight-average particle size (D4) of 4 to 10 pm and a particle size distribution of containing at most 50% by volume of particles of 10.1 pm or larger; more preferably D4=5 to 9 $\mu$m and at most 40% by volume of particles of 10.1 $\mu$m or larger; further preferably D4=5.5 to 8 $\mu$m and at most 20% by volume of particles of 10.1 $\mu$m or larger. If D4 is below 4 $\mu$m or above 10 $\mu$m, or the particles of 10.1 $\mu$m or larger are contained in more than 50% by volume, it becomes difficult to produce toner particles satisfying a circularity range suitable for the present invention.

The toner of the present invention may preferably contain a charge control agent, which may be any of known ones (e.g., organometallic compounds and resinous charge control agents) including organic aluminum compounds and organic iron compounds as preferred ones.

The organic aluminum compounds may include reaction products of aluminum compounds with an aromatic diol, an aromatic hydroxycarboxylic acid, an aromatic monocarboxylic acid or an aromatic polycarboxylic acid, inclusive of organic aluminum complex compounds (complexes and complex salts) and organic aluminum salts. It is particularly preferred to use an organic aluminum compound formed of 2 mols of 3,5-di-tert-butylsalicylic acid and 1 mol of aluminum. Such an organic aluminum compound may be contained in a proportion of 0.02–2 wt. %, preferably 0.05–1.5 wt. %, further preferably 0.1–1 wt. %, as aluminum content in the toner. If the content is below 0.02 wt. %, the toner is liable to have inferior anti-high-temperature offset characteristic, and if the content is above 2 wt. %, the toner is liable to have inferior low-temperature fixability.

The organic iron compounds may include reaction products of monoazo compounds and iron compounds. Such an organic iron compound may be used in an amount of providing an iron content in the toner of 0.02–2 wt. %, preferably 0.05–1.5 wt. %, further preferably 0.1–1 wt. %. If the iron content is below 0.02 wt. %, the resultant toner is liable to show a lower image density in a high temperature/high humidity environment, and above 2 wt. %, the image density stability is liable to be lowered in a normal temperature/low humidity environment.

In the present invention, it is particularly to use an organic iron compound formed of iron and a monoazo compound of formula (4) below:

(4)

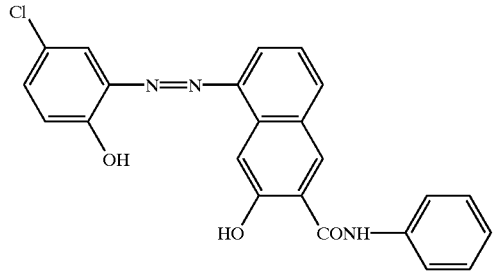

In the case of using an organic aluminum compound as a charge control agent, an interaction between the aluminum and a carboxyl group in the binder resin (a kind of complex-forming reaction which may be assumed as a ligand-exchange reaction) occurs during the melt-kneading step for toner production, thereby resulting in the THF-insoluble matter in the toner binder resin, which may be advantageous for improving the anti-offset property of the toner and providing a suitable wax dispersion state.

In the case of providing a magnetic toner, a magnetic material is used also functioning as a colorant. The magnetic material may comprise a magnetic oxide, such as magnetite, maghemite or ferrite, and more preferably a magnetic iron oxide containing a non-iron element or a mixture thereof.

Examples of the non-iron element may include: lithium, beryllium, boron, magnesium, aluminum, silicon, phosphorus, sulfur, germanium, tetranium, zirconium, tin, lead, zinc, calcium, barium, chromium, manganese, cobalt. copper, nickel, gallium, indium, silver, palladium, gold, platinum, tungsten, molybdenum, niobium, osmium, strontium, yttrium technetium, ruthenium, rhodium and bismuth. Preferred examples include: lithium, beryllium, boron, magnesium, aluminum, silicon, phosphorus, germanium, titanium, zirconium, tin, sulfur, calcium, barium, vanadium, chromium, manganese, cobalt, copper, nickel, strontium, bismuth and zinc. It is particularly preferred to use a magnetic iron oxide containing a non-iron element selected from magnesium, aluminum, silicon, phosphorus and zirconium. Such a non-iron element may be incorporated in the iron oxide crystal lattice, may be incorporated in the form of an oxide thereof in the iron oxide or may be present as an oxide or a hydroxide at the surface of magnetic iron oxide particles. It is preferred that the non-iron element is contained in the form of an oxide thereof.

Such a non-iron element can be incorporated in the magnetic particles by pH adjustment of an aqueous system for producing the magnetic material also containing a salt of the non-iron element. The precipitation of such a non-iron element on the magnetic particles can be effected by pH adjustment or a combination of addition of a salt of the element and pH adjustment, after formation of the magnetic particles.

A magnetic material containing such a non-iron element generally shows a good affinity with a toner binder resin, particularly with a toner binder resin having a specific acid value, and advantageously affects the dispersion of a charge control agent in a suitable state. Further, such a magnetic material can be formed in a narrow particle size distribution and is well dispersed in the binder resin, to result in a toner having improved uniformity and stability of chargeability. This is effective for providing an improvement in resistance to toner agglomeration due to non-uniform charges of toner particles of smaller particle size which is preferred in recent years. Consequently, the toner of the present invention can be provided with remarkably improved developing performances, such as increased image density and anti-fog characteristic.

Such a non-iron element may preferably be contained in a proportion of 0.05–10 wt. %, more preferably 0.1–7 wt. %, further preferably 0.2–5 wt. %, particularly preferably 0.3–4 wt. %, based on the iron (element) in the magnetic iron oxide. Below 0.05 wt. %, the effects of the element addition become scarce, thus being liable to fail in providing good dispersibility and uniform chargeability. Above 10 wt. %, the charge liberation is increased to result in an insufficient charge which leads to lower image density and increased fog.

Such a non-iron element may preferably be dominantly present in proximity to the surface of the magnetic particles. More specifically, it is preferred that 20–100 wt. %, more preferably 25–100 wt. % of the non-iron element is dissolved at a point of 20 wt. % dissolution of the iron in the iron oxide. By the dominant presence near the magnetic particle surface of the non-iron element, it is possible to enhance the dispersion effect and the electrical diffusion effect.

The magnetic material may preferably have a number-average particle size (D1) of 0.05–1.0 $\mu$m, more preferably 0.1–0.5 $\mu$m. The magnetic material may preferably have a BET specific surface area ($S_{BET}$) of 2–40 $m^2/g$, more preferably 4–20 $m^2/g$. The magnetic material may preferably have magnetic properties including a saturation magnetization of 10–200 $Am^2/kg$, more preferably 70–100 $Am^2/kg$, as measured at a magnetic field of 795.8 kA/m; a residual magnetization of 1–100 $Am^2/kg$, more preferably 2–20 $Am^2/kg$, and a coercive force of 1–30 kA/m, more preferably 2–15 kA/m. The magnetic material may be added in an amount of 20–200 wt. parts per 100 wt. parts of the binder resin.

The contents of elements in the magnetic material may be measured by fluorescent X-ray analysis according to JIS K0119 (fluorescent X-ray analysis: general rules) by using a fluorescent X-ray analyzer (e.g., "SYSTEM 3080", made by Rigaku Denki Kogyo K.K.). The elementary distribution may be determined by gradual dissolution of a magnetic material with hydrochloric acid or hydrofluoric acid, and measuring the change in element content in the solution by ICP (inductively coupled plasma) emission spectroscopy.

The number-basis particle size distribution of a magnetic material may be measured by processing enlarged photographs taken through a transmission electron microscope by means of a digitizer, etc. The magnetic properties are based on values measured by using a sample vibration-type magnetometer ("VSM-3S-15", made by Toei Kogyo K.K.) and applying an external magnetic field of 795.8 kA/m. The specific surface areas described herein are based on values measured according to the BET multi-point method using nitrogen as the adsorbate gas and by using a specific surface area measurement apparatus ("Autosorb 1", made by Yuasa Ionics K.K.).

In the case of providing a non-magnetic toner, arbitrary pigments or dyes may be added. Examples of the pigment may include: carbon black, aniline black, acetylene black, Naphthol Yellow, Hansa Yellow, Rohdamine Yellow, Alizarin Yellow, red iron oxide, and Phthalocyanine Blue. The pigment may be used in an amount for providing a sufficient optical density, e.g., 0.1–20 wt. parts, preferably 0.2–10 wt. parts, per 100 wt. parts of the binder resin. For a similar purpose, a dye can be used. Examples thereof may include: azo dyes, anthraquinone dyes, xanthene dyes and methine dyes. The dye may be used in 0.1–20 wt. parts, preferably 0.3–10 wt. parts, per 100 wt. parts of the binder resin.

The toner of the present invention may contain a flowability-improving agent externally added to toner particles. Examples thereof may include: fine powders of fluorine-containing resins, such as polyvinylidene fluoride and polytetrafluoroethylene; fine powders of inorganic oxides such as wet-process silica, dry-process silica, titanium oxide and alumina, and surface-treated products of these inorganic oxide fine powders treated with silane compounds, titanate coupling agent and silicone oil.

It is preferred to use a so-called dry-process silica or fumed silica, which is fine powdery silica formed by vapor-phase oxidation of a silicone halide, e.g., silicon tetrachloride. The basic reaction may be represented by the following scheme:

$$SiCl_4+2H_2+O_2 \rightarrow SiO_2+4HCl.$$

In the reaction step, another metal halide, such as aluminum chloride or titanium, can be used together with the silicon halide to provide complex fine powder of silica and another metal oxide, which can be also used as a type of silica as a preferred flowability-improving to be used in the toner of the present invention. The flowability-improving agent may preferably have an average primary particle size of 0.001–2 $\mu$m, more preferably 0.002–0.2 $\mu$m.

Examples of commercially available silica fine powder products formed by vapor-phase oxidation of silicon halides may include those available under the following trade names.

| | |
|---|---|
| Aerosil (Nippon Aerosil K.K.) | 130 |
| | 200 |
| | 300 |

-continued

| | |
|---|---|
| | 380 |
| | TT600 |
| | MOX170 |
| | MOX80 |
| | COK84 |
| Ca—O—SiL (Cabot Co.) | M-5 |
| | MS-7 |
| | MS-75 |
| | HS-5 |
| | EH-5 |
| Wacker HDK N20 (Wacker-Chemie CMBH) | V15 |
| | N20E |
| | T30 |
| | T40 |
| D-C Fine Silica (Dow Corning Co.) | |
| Fransol (Fransil Co.) | |

It is further preferred to use such silica fine powder after a hydrophobization treatment.

The hydrophobization may be effected to treating the silica fine powder with an organosilicon compound reactive with or physically adsorbed by the silica fine powder.

Examples of the organosilicon compound may include: hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilylmercaptans such as trimethylsilylmercaptan, triorganosilyl acrylates, vinyldimethylacetoxysilane, dimethylethoxysilane, dimethyldimethoxysilane, diphenyldiethoxysilane, hexamethyldisiloxane, 1,3-divinyltetramethyldisiloxane, 1,3-diphenyltetramethyldisiloxane, and dimethylsiloxanes having 2–12 siloxane units per molecule including terminal units each having one hydroxyl group connected to Si; and further silicone oils, such as dimethylsilicone oil. These organosilicon compounds may be used singly, or in mixture, or in succession of two or more species.

The flowability-improving agent may preferably have a methanol wettability of at least 30%, more preferably at least 50%, and also have a specific surface area as measured by the BET method using nitrogen adsorption ($S_{BET}$) of at least 30 $m^2/g$, more preferably at least 50 $m^2/g$. The flowability-improving agent may preferably be used in a proportion of 0.01–8 wt. parts, more preferably 0.1–4 wt. parts, per 100 wt. parts of the toner.

The toner of the present invention can contain various additives, in addition to the flowability-improving agent, for imparting various properties. Examples of such additives may include the following.

(1) Abrasives, inclusive of: metal oxides, such as strontium titanate, cerium oxide, aluminum oxide, magnesium oxide and chromium oxide; nitrides, such as silicon nitride; carbides, such as silicon carbide; metal salts, such as calcium sulfate, barium sulfate and calcium carbonate.

(2) Lubricants, inclusive of: powders of fluorine-containing resins, such as polyvinylidene fluoride and polytetrafluoroethylene; and fatty acid metal salts, such as zinc stearate and calcium stearate.

(3) Charge-controlling particles, inclusive of: particles of metal oxides, such as tin oxide, titanium oxide, zinc oxide, silicon oxide, and aluminum oxide; carbon black, and resin particles.

These additives may be added in an amount of 0.05–10 wt. parts, preferably 0.1–5 wt. parts, per 100 wt. parts of the toner particles. These additives may be used singly or in combination of two or more species.

In the case of providing a magnetic toner, it is preferred to add two or species of additives in combination in view of the stability of continuous developing performance and the stability of developing performance after standing. In the case of providing a non-magnetic monocomponent developer, it is preferred to use titanium oxide or alumina in view of the improved flowability and image uniformity.

The toner of the present invention can also be blended with a carrier to provide a two-component developer. The carrier may preferably have a resistivity of $10^6$–$10^{10}$ ohm.cm adjusted, e.g., by controlling the surface unevenness of carrier particles and the amount of a surface-coating resin.

Example of the surface-coating resin may include: styrene-acrylate copolymers, styrene-methacrylate copolymers, acrylate ester copolymers, methacrylate ester copolymers, silicone resin, fluorine-containing resin, polyamide resin, ionomer resin, polyphenylene sulfide resin, and mixture of these resins.

The carrier core may comprise a magnetic material, examples of which may include: oxides, such as ferrite, iron-excessive ferrite, magnetite and gamma-iron oxide; metals, such as iron, cobalt and nickel, and alloys of these metals. These magnetic materials can further contain other elements, such as iron, cobalt, nickel, aluminum, copper, lead, magnesium, tin, zinc, antimony, beryllium, bismuth, calcium, manganese, selenium, titanate, tungsten, and vanadium.

Next, some image forming methods wherein the toner of the present invention is suitably used, will be described.

An embodiment of the image forming method using a toner, particularly a magnetic toner, according to the present invention will be described with reference to FIGS. 1 and 2. The surface of an image-bearing member (photosensitive member) 1 is charged to a negative potential or a positive potential by a primary charger 2 and exposed to image light 5 as by analog exposure or laser beam scanning to form an electrostatic image (e.g., a digital latent image as by laser beam scanning) on the photosensitive member. Then, the electrostatic image is developed with a magnetic toner 13 carried on a developing sleeve 4 according to a reversal development mode or a normal development mode. The toner 13 is initially supplied to a vessel of a developing device 9 and applied as a layer by a magnetic blade 11 on the developing sleeve 4 containing therein a magnet 23 having magnetic poles $N_1$, $N_2$, $S_1$ and $S_2$. At the development zone, a bias electric field is formed between the electroconductive substrate 16 of the photosensitive member 1 and the developing sleeve 4 by applying an alternating bias, a pulse bias and/or a DC bias voltage from a bias voltage application means 12 to the developing sleeve 4.

Figure 2:
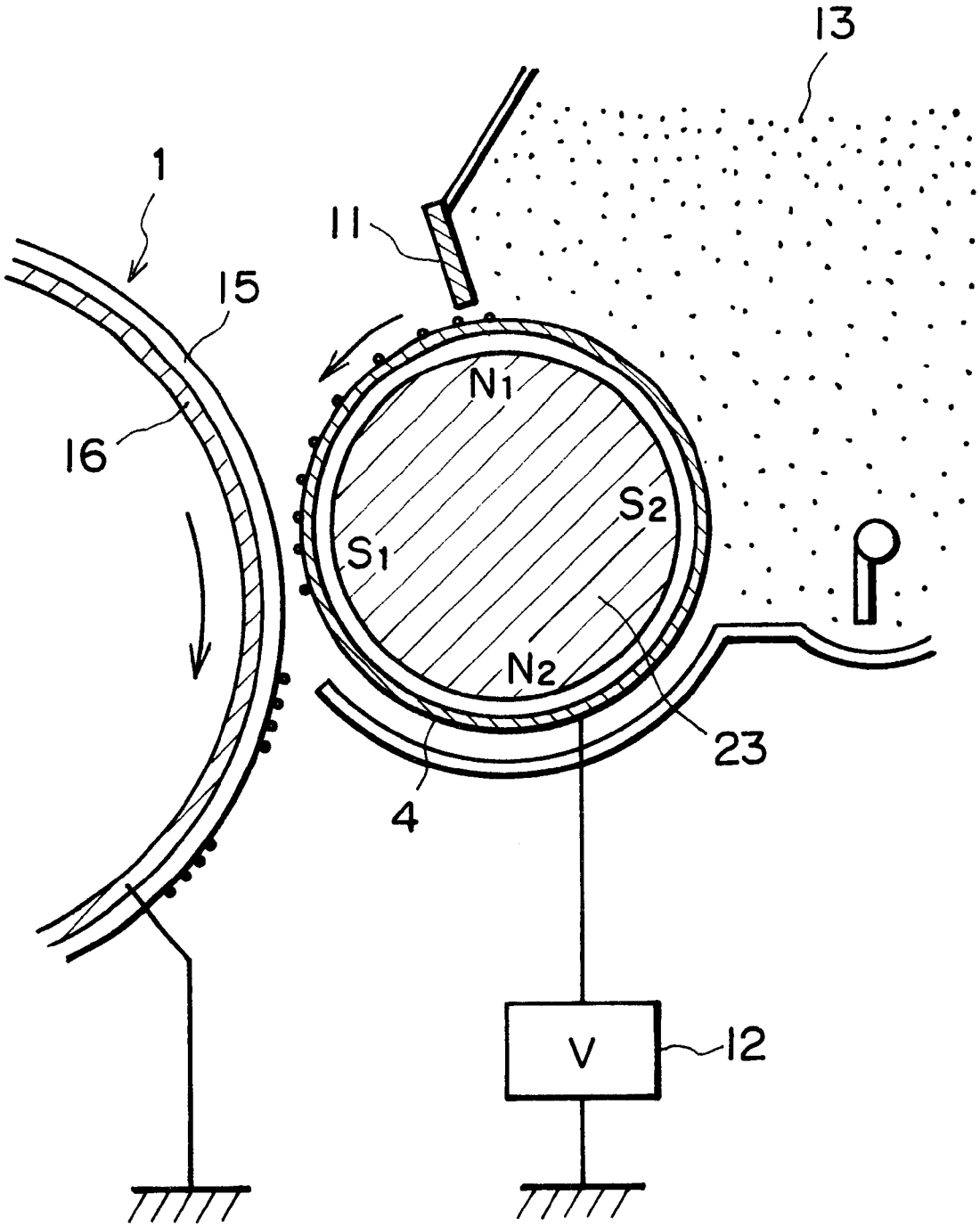
FIG. 2 is an enlarged view of a developing section of the image forming apparatus shown in FIG. 1.

The magnetic toner image thus formed on the photosensitive member 1 is transferred via or without via an intermediate transfer member onto a recording material (transfer paper) P (FIG. 1 illustrates an apparatus including no intermediate transfer member). When transfer paper P is conveyed to a transfer position, the back side (i.e., a side opposite to the photosensitive member) of the paper P is positively or negatively charged by a transfer charger 3 to electrostatically transfer the negatively or positively charged magnetic toner image on the photosensitive member 1 onto the transfer paper P. Then, the transfer paper P carrying the toner image is charge-removed by discharge means 22, separated from the photosensitive member 1 and subjected to heat-pressure fixation of the toner image by a hot pressure roller fixing device 7 containing therein heaters 21.

Residual magnetic toner remaining on the photosensitive member 1 after the transfer step is removed by a cleaning means comprising a cleaning blade 8. The photosensitive member 1 after the cleaning is charge-removed by erase exposure means 6 and then again subjected to an image forming cycle starting from the charging step by the primary charger 2.

Figure 8:
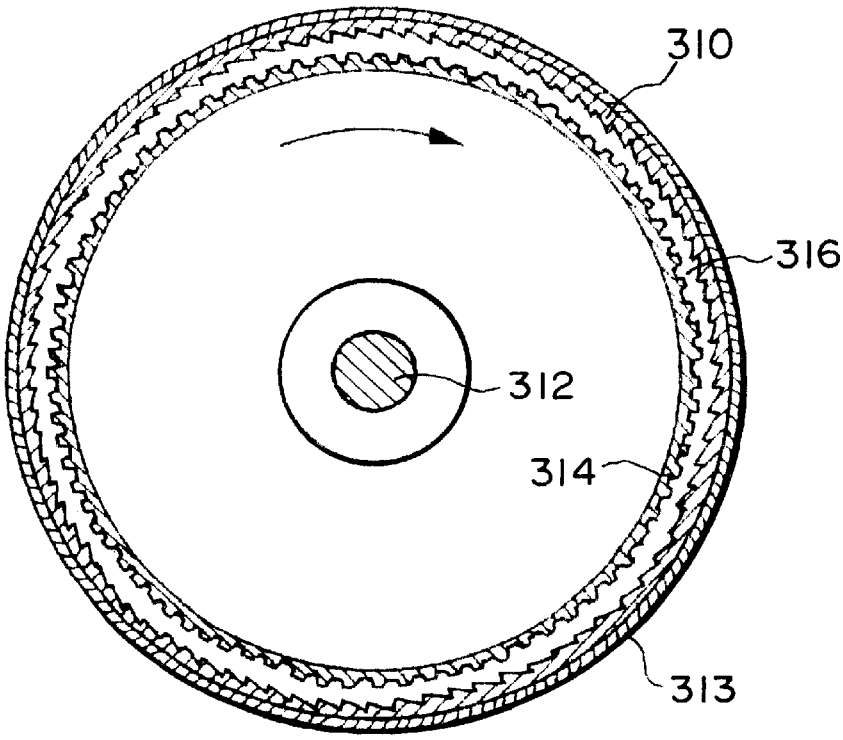
FIG. 8 is a schematic sectional view of a D–D' section in FIG. 7.

The electrostatic image bearing or photosensitive member in the form of a drum 1 may comprise a photosensitive layer 15 formed on an electroconductive support 16 (FIG. 8). The non-magnetic cylindrical developing sleeve 4 is rotated so as to move in an identical direction as the photosensitive member 1 surface at the developing position. Inside the non-magnetic cylindrical developing sleeve 4, a multi-polar permanent magnet (magnet roll) 23 is disposed so as to be not rotated. The magnetic toner 13 in the developing device 9 is applied onto the developing sleeve 4 and provided with a triboelectric change due to friction between the developing sleeve 4 surface and the magnetic toner particles. Further, by disposing an iron-made magnetic blade 11 in proximity to (e.g., with a gap of 50–500 $\mu$m from) the developing sleeve 4 surface so as to be opposite to one magnetic pole of the multi-polar permanent magnet, the magnetic toner is controlled to be in a uniformly small thickness (e.g., 30–300 $\mu$m) that is identical to or smaller than the clearance between the photosensitive member 1 and the developing sleeve 4 at the developing position. The rotation speed of the developing sleeve 4 is controlled so as to provide a circumferential velocity identical or close to that of the photosensitive member 1 surface. The iron blade 11 as a magnetic doctor blade can be replaced by a permanent magnet so as to provide a counter magnetic pole. At the developing position, an AC bias or a pulse bias voltage may be applied to the developing sleeve 4 from a bias voltage application means 12.

The AC bias voltage is applied in order to provide a good combination of image density and fog-free state by using a toner exhibiting a specific dielectric property according to the present invention and may preferably have a frequency f of 600–4,000 Hz, more preferably 800–3000 Hz, further preferably 1100–2500 Hz, and a peak-to-peak voltage Vpp of 500–3,000 volts.

Under the action of an electrostatic force on the photosensitive member surface and the AC bias or pulse bias electric field at the developing position, the magnetic toner particles are transferred onto an electrostatic image on the photosensitive member 1.

It is also possible to replace the magnetic blade 11 with an elastic blade comprising an elastic material, such as silicone rubber, so as to apply a pressing force for applying a magnetic toner layer on the developing sleeve while regulating the magnetic toner layer thickness.

In the image forming method of the present invention, the image-bearing member 1 may comprise a photoconductor, such as amorphous silicon (a-Si), an organic photoconductor (OPC), selenium or another inorganic photoconductor. In view of the stability of latent image potential. It is preferred to use an a-Si or OPC photoconductor. In a high-speed machine requiring a durability of the photosensitive member, it is particularly preferred to use an a-Si photoconductor.

Another image forming method to which the toner according to the present invention is applicable will now be described with reference to FIG. 3.

Figure 3:
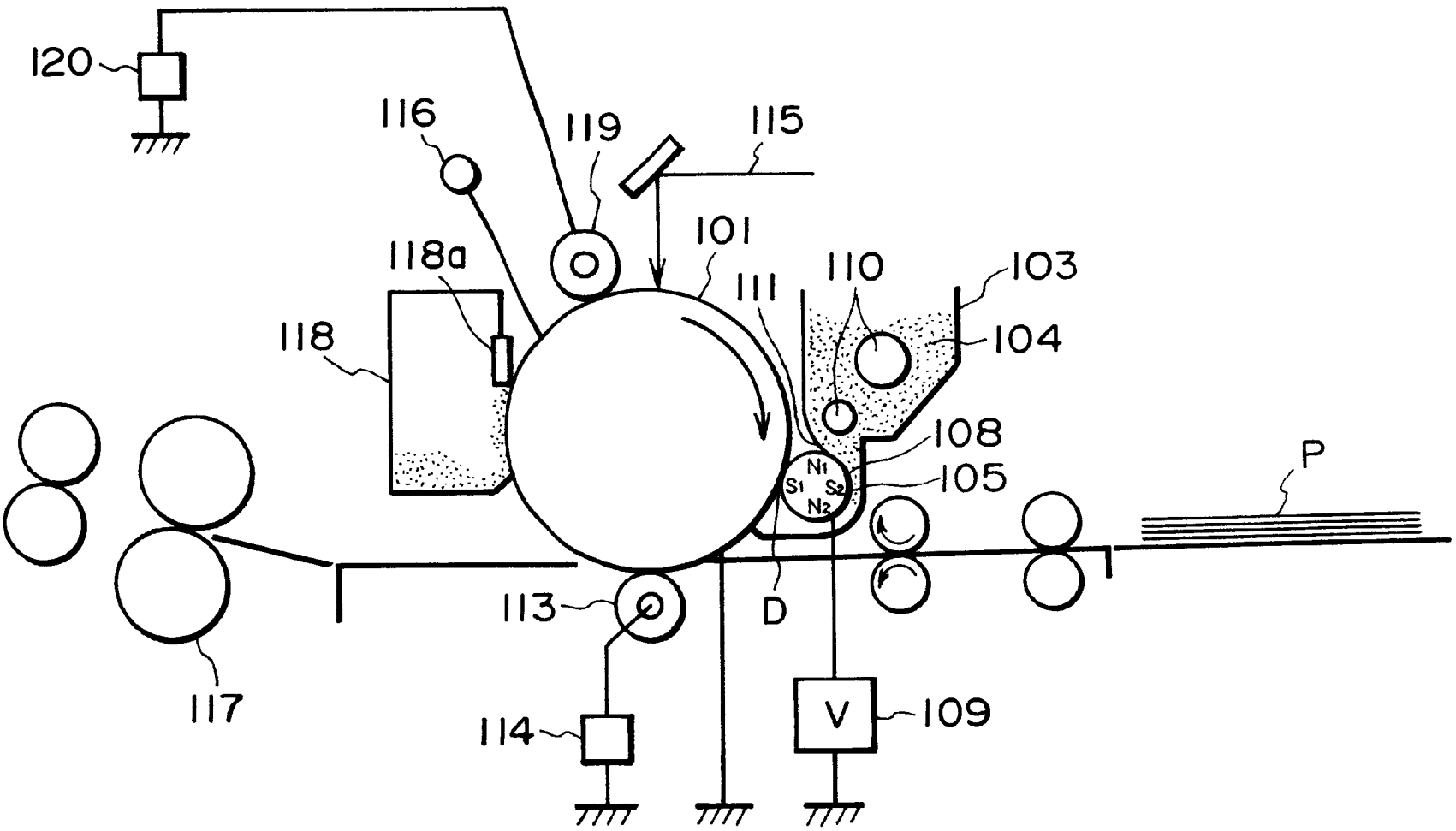

Referring to FIG. 3, the surface of a photosensitive drum 101 as an electrostatic image-bearing member is charged to a negative polarity by a contact (roller) charging means 119 as a primary charging means supplied with a voltage from a voltage application means and exposed to image scanning light 115 from a laser to form a digital electrostatic latent image on the photosensitive drum 101. The digital latent image is developed by a reversal development mode with a magnetic toner 104 held in a hopper 103 of a developing device equipped with a developing sleeve 108 (as a toner-carrying member) enclosing a multi-polar permanent magnet 105 and an elastic regulating blade 111 as a toner layer thickness-regulating member. As shown in FIG. 3, at a developing region D, an electroconductive substrate of the photosensitive drum 101 is grounded, and the developing sleeve 108 is supplied with an alternating bias, a pulse bias and/or a direct current bias from a bias voltage application means 109. When a recording material P is conveyed and arrives at a transfer position, a backside (opposite to the photosensitive drum) of the recording material P is charged by a contact (roller) transfer means 113 as a transfer means connected to a voltage application means 114, whereby the toner image formed on the photosensitive drum 101 is transferred onto the recording material P. The recording material P is then separated from the photosensitive drum 101 and conveyed to a hot pressure roller fixing device 117 as a fixing means, whereby the toner image is fixed onto the recording material P.

A portion of the magnetic toner 104 remaining on the photosensitive drum 101 after the transfer step is removed by a cleaning means 118 having a cleaning blade 118*a*. If the amount of the residual toner is little, the cleaning step can be omitted. The photosensitive drum 101 after the cleaning is charge-removed by erasure exposure means 116, as desired, and further subjected a series of the above-mentioned steps starting with the charging step by the contact (roller) charging means 119 as a primary charging means.

In the above-mentioned series of steps, the photosensitive drum 101 (i.e., an electrostatic image-bearing member) comprises a photosensitive layer and an electroconductive substrate, and rotates in a direction of an indicated arrow. The developing sleeve 108 as a toner-carrying member in the form of a non-magnetic cylinder rotates so as to move in a direction to the surface-moving direction of the photosensitive drum 101 at the developing region D. Inside the developing sleeve 108, a multi-polar permanent magnet (magnet roll) 105 is disposed so as not to rotate. The magnetic toner 104 in the developer vessel 103 is applied onto the developing sleeve 108 and provided with a triboelectric charge of, e.g., negative polarity, due to friction with the developing sleeve 108 surface and/or other magnetic toner particles. Further, the elastic regulation blade 111 is elastically pressed against the developing sleeve 108 so as to regulate the toner layer in a uniformly small thickness (30–300 $\mu$m) that is smaller than a gap between the photosensitive drum 101 and the developing sleeve 108 in the developing region D. The rotation speed of the developing sleeve 108 is adjusted so as to provide a surface speed thereof that is substantially equal or close to the surface speed of the photosensitive drum 101. In the developing region D, the developing sleeve 108 may be supplied with a bias voltage comprising an AC bias, a pulse bias on an AC-DC superposed bias from the bias voltage application means 109. The AC bias may have f=600–4000 Hz, preferably 800–3000 Hz, further preferably 1100–2500 Hz, and Vpp=500–3000 volts.

At the developing region, the magnetic toner is transferred onto the electrostatic image side under the action of an electrostatic force on the photosensitive drum 101 surface and the developing bias voltage.

Figure 4:
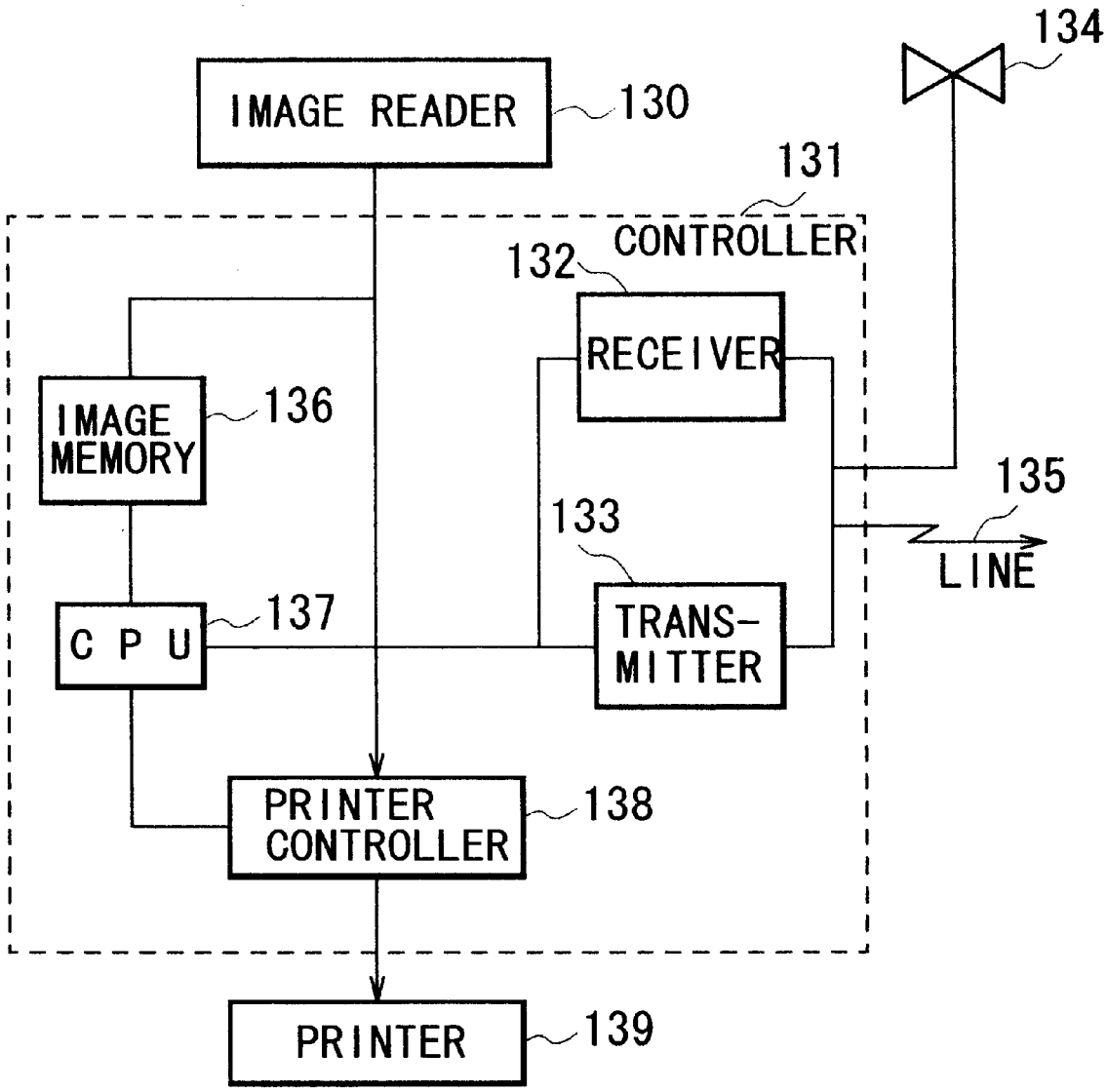
FIG. 4 is a block diagram of a facsimile apparatus system including an image forming apparatus for practicing an embodiment of the image forming method according to the invention as a printer.

In case where an image forming apparatus as described above is used as a printer for facsimile, the above-mentioned image exposure means corresponds to that for printing received data. FIG. 4 shows such an embodiment by using a block diagram.

Referring to FIG. 4, a controller 131 controls an image reader (or image reading unit) 130 and a printer 139. The entirety of the controller 131 is regulated by a CPU (central processing unit) 137. Read data from the image reader 130 is transmitted through a transmitter circuit 133 to another terminal such as facsimile. On the other hand, data received from another terminal such as facsimile is transmitted through a receiver circuit 132 to the printer 139. An image memory 136 stores prescribed image data. A printer controller 138 controls the printer 139. In FIG. 17, reference numeral 134 denotes a telephone set.

More specifically, an image received from a line (or circuit) 135 (i.e., image information received from a remote terminal connected by the line) is demodulated by means of the receiver circuit 132, decoded by the CPU 137, and sequentially stored in the image memory 136. When image data corresponding to at least one page is stored in the image memory 136, image recording is effected with respect to the corresponding page. The CPU 137 reads image data corresponding to one page from the image memory 136, and transmits the decoded data corresponding to one page to the printer controller 138. When the printer controller 138 receives the image data corresponding to one page from the CPU 137, the printer controller 138 controls the printer 139 so that image data recording corresponding to the page is effected. During the recording by the printer 139, the CPU 137 receives another image data corresponding to the next page. Thus, receiving and recording of an image may be effected by means of the apparatus shown in FIG. 4 in the above-mentioned manner.

The toner particles constituting the toner of the present invention may preferably be produced through a process wherein the above-mentioned toner ingredients including the binder resin, the colorant and the wax are sufficiently blended by means of a ball mill, a Henschel mixer, etc. and then melt-kneaded by hot kneading means, such as a hot roller kneader or an extruder, and after being solidified by cooling, the melt-kneaded product is coarsely crushed and finely pulverized by the action of a jet stream or mechanically, followed by classification, to recover toner particles. Other production processes may include a polymerization toner production process wherein prescribed ingredients are blended with a monomer constituting the binder resin, and the resultant polymerizable mixture is suspended in an aqueous medium and polymerized to form toner particles; a microencapsule toner production process wherein prescribed ingredients are incorporated in ether one or both of the core material and the shell material; and a spray drying process wherein a dispersion of prescribed ingredients in a binder resin solution is spray-dried to form toner particles. The thus-obtained toner particles are optionally blended with external additives as desired by a blender, such as a Henschel mixer to obtain a toner of the present invention.

Figure 5:
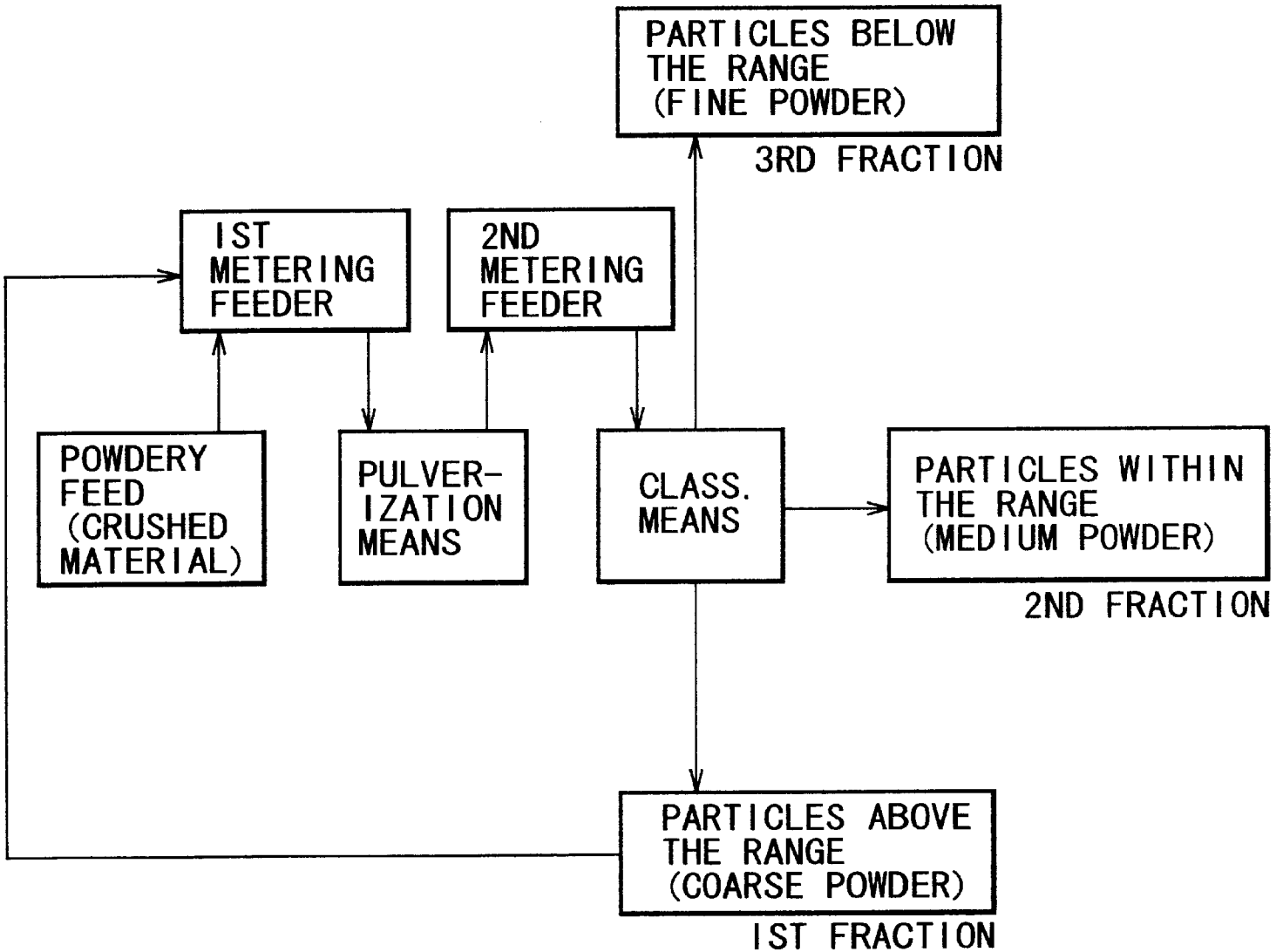
FIG. 5 is a flow chart for illustrating an example of toner production process suitable for producing the toner of the invention.

Next, a preferred process of producing the toner of the present invention will now be described with reference to the accompanying drawings. FIG. 15 is a flow chart for illustrating an outline of a pulverization and classification system adopted in the process. In the process, the toner ingredients comprising at least a binder resin and a colorant are melt-kneaded, and the melt-kneaded product after cooling is coarsely crushed by a crushing means to obtain a powdery feed comprising the crushed product. In the pulverization and classification system shown in FIG. 5, the powdery feed is introduced into a first metering feeder and then supplied from the first metering feeder to an inlet port of a mechanical pulverizer including at least a rotor comprising a rotating member affixed to a central rotation shaft, and a stator housing the rotor with a prescribed spacing from the rotor surface, so that an annular space given by the spacing is made airtight, and the rotor is rotated at a high speed to finely pulverize the coarsely pulverized material. Then, the fine pulverizate discharged out of the discharge port of the mechanical pulverization is introduced at a prescribed rate via a second metering feeder to a multi-division classifier wherein the fine pulverizate is pneumatically classified into at least a fine powder fraction, a medium powder fraction and a coarse powder fraction under the action of crossing gas streams and the Coanda effect. The classified coarse powder fraction is blended with the powdery feed for reintroduction into the mechanical pulverizer, and the classified medium powder fraction is recovered by toner particles.

Figure 6:
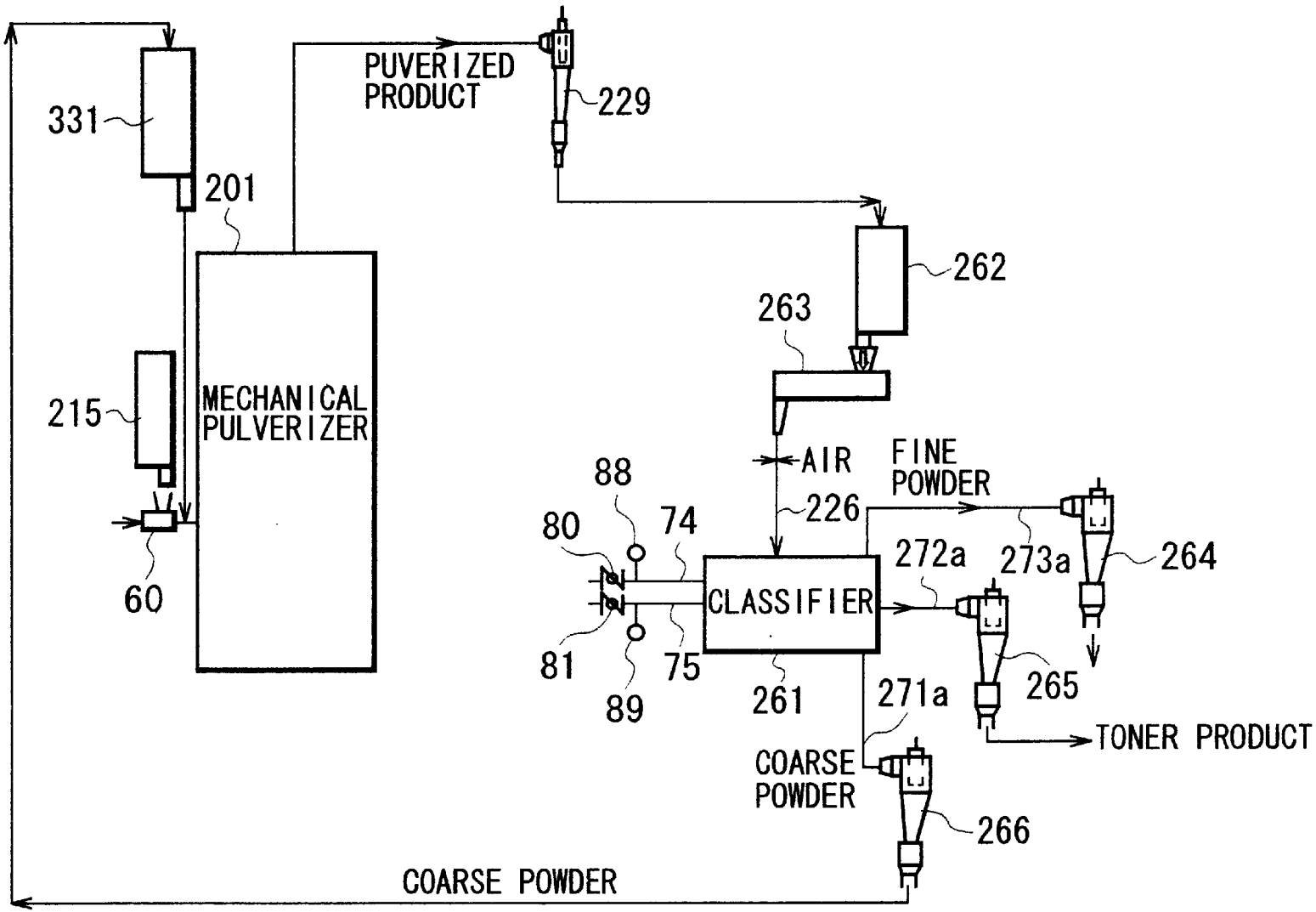
FIG. 6 illustrates an example of the apparatus system for practicing the toner production process.

Referring to FIG. 6, the powdery feed is introduced at a prescribed rate to a mechanical pulverizer 201 as pulverization means via a first metering feeder 215. The introduced powdery feed is instantaneously pulverized by the mechanical pulverizer 201, introduced via a collecting cyclone 229 to a second metering feeder 262 and then supplied to a multi-division pneumatic classifier 261 via a vibration feeder 263 and a feed supply nozzle 276.

In the apparatus system, the ratio between the feed rate to the mechanical pulverizer 301 from the first metering feeder 215 and the feed rate to the multi-division pneumatic classifier 261 via the second metering feeder 262, may preferably be set to 0.7–1.7 times, more preferably 0.7–1.5 times, further preferably 1.0–1.2 times, in view of the toner productivity and production efficiency.

Figure 10:
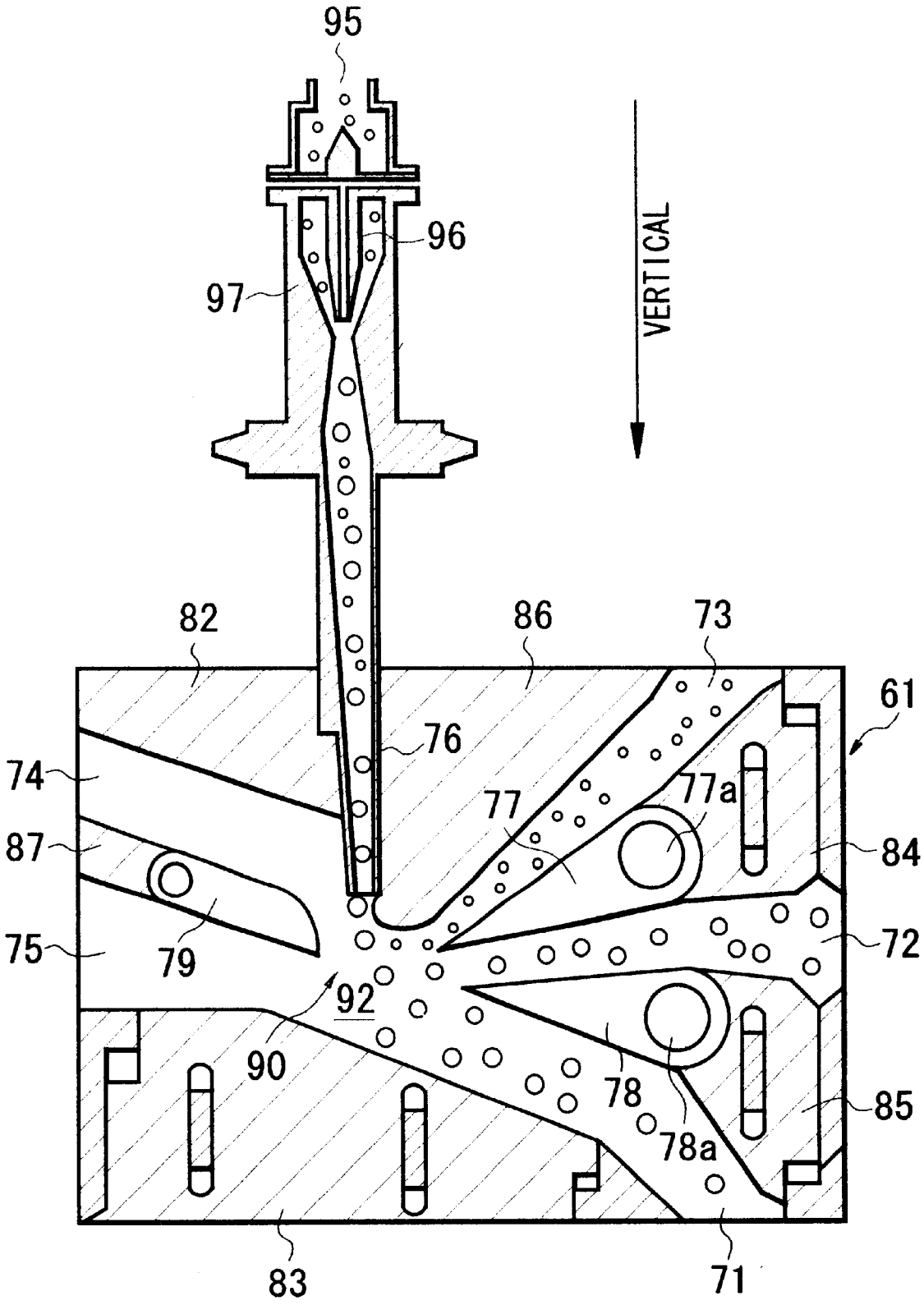
FIG. 10 is a schematic sectional view of a multi-division pneumatic classifier used in a toner classification-step.

A pneumatic classifier is generally incorporated in an apparatus system while being connected with other apparatus through communication means, such as pipes. FIG. 6 illustrates a preferred embodiment of such an apparatus system. The apparatus system shown in FIG. 6 includes the multi-division classifier 261 (the details of which are illustrated in FIG. 10), the metering feeder 262, the vibration feeder 263, and collecting cyclones 264, 265 and 266, connected by communication means.

In the apparatus system, the pulverized feed is supplied to the metering feeder 262 and then introduced into the three-division classifier 261 via the vibration feeder 263 and the feed supply nozzle 16 at a flow speed of 10–350 m/sec. The three-division classifier 261 includes a classifying chamber ordinarily measuring 10–50 cm×10–50 cm×3–50 cm, so that the pulverized feed can be classified into three types of particles in a moment of 0.1–0.01 sec or shorter. By the classifier 261, the pulverized feed is classified into coarse particles, medium particles and fine particles. Thereafter, the coarse particles are sent out of an exhaust pipe 271*a* to a collecting cyclone 266 and then recycled to the mechanical pulverizer 201. The medium particles are sent through an exhaust pipe 272*a* and discharge out of the system to be recovered by a collecting cyclone 265 as a toner product. The fine particles are discharged out of the system via an exhaust pipe 273*a* and are discharged out of the system to be collected by a collecting cyclone 264. The collected fine particles are supplied to a melt-kneading step for providing a powdery feed comprising toner ingredients for re-utilization, or are discarded. The collecting cyclones 264, 265 and 266 can also function as a suction vacuum generation means for introducing by sucking the pulverized feed to the classifier chamber via the feed supply nozzle. The coarse particles classified out of the classifier 261 may preferably be recycled via a recycle metering feeder 331 and mixed with a fresh powdery feed supplied from the first metering feeder 215 and re-pulverized in the mechanical pulverizer 201.

The rate of re-introduction of the coarse particles to the mechanical pulverizer 201 from the pneumatic classifier 261 may preferably be set to 0–10.0 wt. %, more preferably 0–5.0 wt. %, of the pulverized feed supplied from the second metering feeder 262 in view of the toner productivity. If the rate of re-introduction exceeds 10.0 wt. %, the powdery dust concentration in the mechanical pulverizer 201 is raised to increase the load on the pulverizer 201, and the toner productivity can be lowered due to difficulties, such as overpulverization heat causing toner surface deterioration, isolation of the magnetic iron oxide particles from the toner particles and melt-sticking onto the apparatus wall.

The powdery feed to the apparatus system may preferably have a particle size distribution such that at least 95 wt. % is 18 mesh-pass and at least 90 wt. % is 100 mesh-on (according to ASTME-11–61).

In order to produce a toner having a weight-average particle size (D4) of at most 10 $\mu$m, preferably at most 8 $\mu$m, and a narrow particle size distribution, the pulverized product out of the mechanical pulverizer may preferably satisfy a particle size distribution including a weight-average particle size of 4–10 $\mu$m, at most 70% by number, more preferably at most 65% by number of particles of at most 4.0 $\mu$m, and at most 25% by volume, more preferably at most 20% by volume, of particles of at least 10.1 $\mu$m. Further, the medium particles classified out of the classifier 261 may preferably satisfy a particle size distribution including a weight-average particle size of 5–10 $\mu$m, at most 40% by number, more preferably at most 35% by number, of particles of at most 4.0 $\mu$m, and at most 25% by volume, more preferably at most 20% by volume, of particles of at least 10.1 $\mu$m.

The above-mentioned apparatus system does not include a first classification step, prior to the pulverization step, and includes a single pass of pulverization step and classification step.

The mechanical pulverizer 201 suitably incorporated in the apparatus system of FIG. 6 may be provide by a commercially available pulverizer, such as "KTM" (available from Kawasaki Jukogyo K.K.) or "TURBOMILL" (available from Turbo Kogyo K.K.), as it is, or after appropriate re-modeling.

Figure 7:
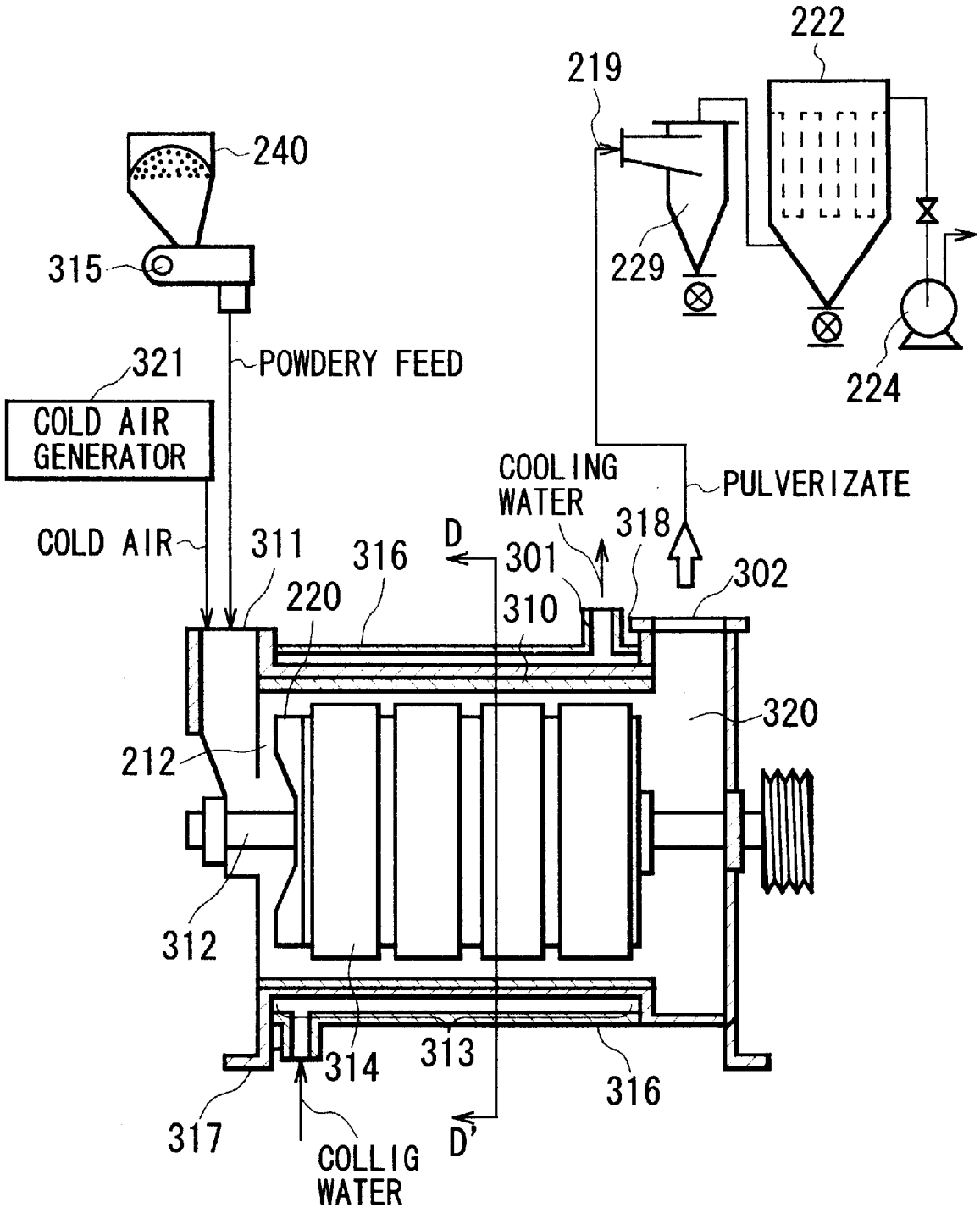
FIG. 7 is a schematic sectional view of a mechanical pulverizer used in a toner pulverization step.
Figure 9:
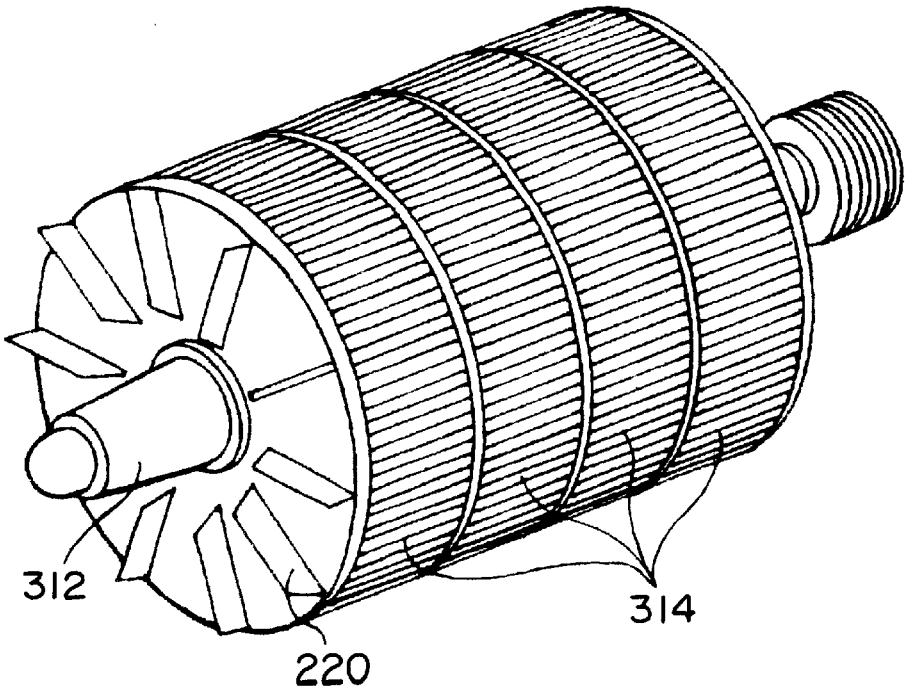
FIG. 9 is a perspective view of a rotor contained in the pulverizer of FIG. 7.

It is particularly preferred to adopt a process using a mechanical pulverizer as illustrated in FIGS. 7–9, so as to allow easy pulverization of the powdery feed and realize effective toner production.

Now, the organization of a mechanical pulverizer will be described with reference to FIGS. 7–9. FIG. 7 schematically illustrates a sectional view of a mechanical pulverizer; FIG. 8 is a schematic sectional view of a D—D section in FIG. 7, and FIG. 9 is a perspective view of a rotor 314 in FIG. 7. As shown in FIG. 7, the pulverizer includes a casing 313; a jacket 316; a distributor 220; a rotor 314 comprising a rotating member affixed to a control rotation shaft 312 and disposed within the casing 313, the rotor 314 being provided with a large number of surface grooves (as shown in FIG. 9) and designed to rotate at a high speed; a stator 310 disposed with prescribed spacing from the circumference of the rotor 314 so as to surround the rotor 314 and provided with a large number of surface grooves; a feed port 311 for introducing the powdery feed; and a discharge port 302 for discharging the pulverized material.

In operation, a powdery feed is introduced at a prescribed rate from the feed port 311 into a processing chamber, where the powdery feed is pulverized in a moment under the action of an impact caused between the rotor 314 rotating at a high speed and the stator 310, respectively provided with a large number of surface grooves, a large number of ultra-high speed eddy flow occurring thereafter and a high-frequency pressure vibration caused thereby. The pulverized product is discharged out of the discharge port 302. Air conveying the powdery feed flows through the processing chamber, the discharge port 302, a pipe 219, a collecting cyclone 229, a bag filter 222 and a suction blower 224 to be discharged out of the system.

The conveying air is cold air generated by a cold air generation means 312 and introduced together with the powdery feed, and the pulverizer main body is covered with a jacket 316 for flowing cooling water (preferably, non-freezing liquid comprising ethylene glycol, etc.), so as to maintain the temperature within the processing chamber at 0° C. or below, more preferably −5 to −15° C., further preferably −7 to −12° C., in view of the toner productivity. This is effective for suppressing the surface deterioration of toner particles due to pulverization heat, particularly the liberation of magnetic iron oxide particles present at the toner particle surfaces and melt-sticking of toner particles onto the apparatus wall, thereby allowing effective pulverization of the powdery feed. The operation at a processing chamber temperature below −15° C. requires the use of flon (having a better stability at lower temperatures but regarded as less advisable from global viewpoint) instead of flon substitute as a refrigeration medium for the cold air generation means.

The cooling water is introduced into the jacket 316 via a supply port 317 and discharged out of a discharge port 318.

In the pulverization operation, it is preferred to set the temperature T1 in a whirlpool chamber 212 (inlet temperature) and the temperature T2 in a rear chamber (outlet temperature) so as to provide a temperature difference ΔT (=T2−T1) of 30–80° C., more preferably 35–75° C., further preferably 37–72° C., thereby suppressing the surface deterioration of toner particle surfaces, and effectively pulverizing the powdery feed. A temperature difference ΔT of below 30° C. suggests a possibility of short pass of the powdery feed without effective pulverization thereof, thus being undesirable in view of the toner performances. On the other hand, ΔT>80° C. suggests a possibility of the overpulverization, resulting in surface deterioration due to heat of the toner particles and melt-sticking of toner particles onto the apparatus wall and thus adversely affecting the toner productivity.

It is preferred that the inlet temperature (T1) in the mechanical pulverizer is set to at most 0° C. and a value which is lower than the glass transition temperature (Tg) of the binder resin by 60–75° C. As a result, it is possible to suppress the surface deterioration of toner particles due to heat, and allow effective pulverization of the powdery feed. Further, the outlet temperature (T2) may preferably be set to a value which is lower by 5–30° C., more preferably 10–20° C., than Tg. As a result, it becomes possible to suppress the surface deterioration of toner particles due to heat, and allow effective pulverization of the powdery feed.

The rotor 314 may preferably be rotated so as to provide a circumferential speed of 80–180 m/s, more preferably 90–170 m/s, further preferably 100–160 m/s. As a result, it becomes possible to suppress insufficient pulverization or overpulverization, and allow effective pulverization of the powdery feed. A circumferential speed below 80 m/s of the rotor 314 is liable to cause a short pass without pulverization of the feed, thus resulting in inferior toner performances. A circumferential speed exceeding 180 m/s of the rotor invites an overload of the apparatus and is liable to cause overpulverization resulting in surface deterioration of toner particles due to heat, and also melt-sticking of the toner particles onto the apparatus wall, thus adversely affecting the toner productivity.

Further, the rotor 314 and the stator 310 may preferably be disposed to provide a minimum gap therebetween of 0.5–10.0 mm, more preferably 1.0–5.0 mm, further preferably 1.0–3.0 mm. As a result, it becomes possible to suppress insufficient pulverization or overpulverization and allow effective pulverization of the powdery feed. A gap exceeding 10.0 mm between the rotor 314 and the stator 310 is liable to cause a short pass without pulverization of the powdery feed, thus adversely affecting the toner performance. A gap smaller than 0.5 mm invites an overload of the apparatus and is liable to cause overpulverization resulting in surface deterioration of toner particles due to heat, and also melt-sticking of the toner particles onto the apparatus wall, thus adversely affecting the toner productivity.

The effective pulverization achieved by the above-mentioned mechanical pulverizer allows the omission of a pre-classification step liable to result in overpulverization and omission of the large-volume pulverization air supply required in the pneumatic pulverizer.

Next, a pneumatic classifier as a preferred classification means for toner production, will be described.

FIG. 10 is a sectional view of an embodiment of a preferred multi-division pneumatic classifier.

Referring to FIG. 10, the classifier includes a side wall 82 and a G-block 83 defining a portion of the classifying chamber, and classifying edge blocks 84 and 85 equipped with knife edge-shaped classifying edges 77 and 78. The G-block 83 is disposed slidably laterally. The classifying edges 77 and 78 are disposed swingably about shafts 77*a* and 78*a* so as to change the positions of the classifying edge tips. The classifying edge blocks 77 and 78 are slidable laterally so as to change horizontal positions relatively together with the classifying edges 77 and 78. The classifying edges 77 and 78 divide a classification zone 90 of the classifying chamber 92 into 3 sections.

A feed port 95 for introducing a powdery feed is positioned at the nearest (most upstream) position of a feed supply nozzle 76, which is also equipped with a high-pressure air nozzle 96 and a powdery feed-introduction nozzle 97 and opens into the classifying chamber 92. The nozzle 716 is disposed on a right side of the side wall 82, and a Coanda block 86 is disposed so as to form a long elliptical arc with respect to an extension of a lower tangential line of the feed supply nozzle 76. A left block 87 with respect to the classifying chamber 92 is equipped with a gas-intake edge 719 projecting rightwards in the classifying chamber 92. Further, gas-intake pipes 74 and 75 are disposed on the left side of the classifying chamber 92 so as to open into the classifying chamber 92. Further, the gas-intake pipes 74 and 75 are equipped with first and second gas introduction control means 80 and 81, like dampers, and static pressure gauges 88 and 89 (as shown in FIG. 6).

The positions of the classifying edges 77 and 78, the G-block 83 and the gas-intake edge 78 are adjusted depending on the pulverized powdery feed to the classifier and desired particle size of the product toner.

On the right side of the classifying chamber 92, there are disposed exhaust ports 71, 72 and 73 communicative with the classifying chamber corresponding to respective classified fraction zones. The exhaust ports 71, 72 and 73 are connected with communication means such as pipes (71*a*, 72*a* and 73*a* as shown in FIG. 6) which can be provided with shutter means, such as valves, as desired.

The feed supply nozzle 76 may comprise an upper straight tube section and a lower tapered tube section. The inner diameter of the straight tube section and the inner diameter of the narrowest part of the tapered tube section may e set to a ratio of 20:1 to 1:1, preferably 10:1 to 2:1, so as to provide a desirable introduction speed.

The classification by using the above-organized multi-division classifier may be performed in the following manner. The pressure within the classifying chamber 92 is reduced by evacuation through at least one of the exhaust ports 71, 72 and 73. The powdery feed is introduced through the feed supply nozzle 76 at a flow speed of preferably 10–350 m/sec under the action of a flowing air caused by the reduced pressure and an ejector effect caused by compressed air ejected through the high-pressure air supply nozzle and ejected to be dispersed in the classifying chamber 92.

The particles of the powdery feed introduced into the classifying chamber 92 are caused to flow along curved lines under the action of the Coanda effect exerted by the Coanda block 86 and the action of introduced gas, such as air, so that coarse particles form an outer stream to provide a first fraction outside the classifying edge 78, medium particles form an intermediate stream to provide a second fraction between the classifying edges 78 and 77, and fine particles form an inner stream to provide a third fraction inside the classifying edge 77, whereby the classified coarse particles are discharged out of the exhaust port 71, the medium particles are discharge out of the exhaust port 72 and the fine particles are discharged out of the exhaust port 73, respectively.

In the above-mentioned powder classification, the classification (or separation) points are principally determined by the tip positions of the classifying edges 77 and 78 corresponding to the lowermost part of the Coanda block 86, while being affected by the suction flow rates of the classified air stream and the powder ejection speed through the feed supply nozzle 76.

The above-mentioned pneumatic classifier is particularly advantageously adopted in production of a toner for use in an electrophotographic image forming method.

Some physical properties of a toner described herein are based on the results of measurement methods described below.

(1) Acid Values of a Toner and Binder Resin

Measured According to JIS K0070

Apparatus: Automatic potentiometric titration apparatus ("AT-400", made by Kyoto Denshi K.K.)

Calibration of apparatus: Performed by using a solvent mixture of toluene 120 ml and ethanol 30 ml.

Measurement temperature: 25° C.

Measurement operation including sample preparation is as follows.

(i) Ca. 1.0 g of a toner or ca. 0.5 g of a binder resin is accurately weighed at W (g) and placed in a 200 ml-beaker, and then 120 ml of toluene is added thereto, followed by stirring by a magnetic stirrer for ca. 10 hours at room temperature (25° C.) for dissolution. Then, 30 ml of ethanol is added thereto to form a toluene/methanol mixture solution as a sample solution. Separately, a mixture of toluene (120 ml) and ethanol (30 ml) is prepared as a blank solution.

(ii) The blank solution is titrated with a 0.1 ml/liter-KOH solution in ethanol having a factor of f, and the amount of the KOH solution used for the titration is measured and recorded at B (ml).

(iii) The sample solution is titrated with the same 0.1 mol/liter-KOH solution, and the amount of the KOH solution, and the amount of the KOH solution used for the titration is recorded at S (ml).

(iv) The acid value of the sample is calculated according to the following equation:

$$\text{Acid value (mgKOH/g)}=\{(S-B)\times f\times 5.61\}\times W.$$

(2) Molecular Weight (Distribution) of THF-Soluble Content

Measured According to the GPC Method

In the GPC apparatus, a column is stabilized in a heat chamber at 40° C., tetrahydrofuran (THF) solvent is caused to flow through the column at that temperature at a rate of 1 ml/min., and ca. 100 $\mu$l of a sample solution in THF is injected. The identification of sample molecular weight and its distribution is performed based on a calibration curve obtained by using several monodisperse polystyrene samples and having a logarithmic scale of molecular weight versus count number. The standard polystyrene samples may be available from, e.g., Toso K.K. or Showa Denko. It is appropriate to use at least 10 standard polystyrene samples having molecular weights ranging from a. $10^2$ to ca. $10^7$. The detector may be an RI (refractive index) detector. It is appropriate to constitute the column as a combination of several commercially available polystyrene gel columns. For example, it is possible to use a combination of Shodex GPC KF-801, 802, 803, 804, 805, 806, 807 and 808P available from Showa Denko K.K.; or a combination of TSKgel G1000H ($H_{XL}$), G2000H ($H_{XL}$), G3000H ($H_{XL}$), G4000H ($H_{XL}$), G5000H ($H_{XL}$), G7000H ($H_{XL}$) and TSKd guard column available from Toso K.K.

A GPC sample solution is prepared in the following manner.

A sample is added to THF and left standing for several hours. Then, the mixture is well shaked until the sample mass disappears and further left to stand still for at least 24 hours. Then, the mixture is caused to pass through a sample treatment filter having a pore size of 0.2–0.5 $\mu$m (e.g., "Maishori Disk H-25–2", available from Toso K.K.) to obtain a GPC sample having a resin concentration of 0.5–5 mg/ml.

(3) THF (tetrahydrofuran)-Insoluble Content

Ca. 0.5–1.0 g of a sample toner is accurately weighed at W1 (g), placed in a cylindrical filter paper ("No. 86R", having a size of 28 mm in diameter and 100 mm in height, available from Toyo Roshi K.K.) and set on a Soxhlet's extractor, followed by 10 hours of extraction with 200 ml of solvent THF on an oil bath adjusted at ca. 120–130° C. so as to allow one refluxing cycle in 120 to 150 sec. The filter paper after the extraction is dried for 10 hours at 70° C. under a reduced pressure to determine a THF-soluble content (W2). A THF-insoluble content in the binder resin is determined based on a THF-insoluble matter weight (W3) other than the binder resin, i.e., the colorant (or/and the magnetic material), etc., according to the following equation:

THF-insoluble content (wt. %)=[((W1−(W2+W3))/(W1−W2)]×100.

(4) Heat-Absorption Peak Temperature (Tabs)

Measurement may be performed in the following manner by using a differential scanning calorimeter ("DSC-7", available from Perkin-Elmer Corp.) according to ASTM D3418-82.

A sample in an amount of about 5 mg is accurately weighed. The sample is placed on an aluminum pan and subjected to measurement in a temperature range of 30–200° C. at a temperature-raising rate of 10° C./min in parallel with a blank aluminum pan as a reference. In the course of temperature increase, a main absorption peak appears at a temperature in the range of 30–200° C. on a DSC curve. The temperature is taken as a heat-absorption peak temperature (Tabs).

(5) Glass Transition Temperature (Tg) of a Binder Resin

Measurement may be performed in the following manner by using a differential scanning calorimeter ("DSC-7", available from Perkin-Elmer Corp.) according to ASTM D3418-82.

A sample in an amount of 5 mg is accurately weighed.

The sample is placed on an aluminum pan and subjected to measurement in a temperature range of 30–200° C. at a temperature-raising rate of 10° C./min in a normal temperature—normal humidity environment in parallel with a blank aluminum pan as a reference.

In the course of temperature increase, a main absorption peak appears in the temperature region of 40–100° C.

In this instance, the glass transition temperature (Tg) is determined as a temperature of an intersection between a DSC curve and an intermediate line passing between the base lines obtained before and after the appearance of the absorption peak.

(6) Toner DSC Curve

A toner's DSC curve is taken in the course of temperature increase similarly as in (3) and (4) above for a wax. Also from the DSC curve, the wax heat-absorption peak temperature (Tabs) and the glass transition temperature (Tg) of the binder resin can be determined.

(7) Molecular Weight Distribution of a Wax

The molecular weight (distribution) of a wax may be measured by GPC under the following conditions:

Apparatus: "GPC-150C" (available from Waters Co.)

Column: "GMH-HT" 30 cm-binary (available from Toso K.K.)

Temperature: 135° C.

Solvent: o-dichlorobenzene containing 0.1% of ionol.

Flow rate: 1.0 ml/min.

Sample: 0.4 ml of a 0.15%-sample.

Based on the above GPC measurement, the molecular weight distribution of a sample is obtained once based on a calibration curve prepared by monodisperse polystyrene standard samples, and re-calculated into a distribution corresponding to that of polyethylene using a conversion formula based on the Mark-Houwink viscosity formula.

The GPC sample is prepared as follows. A sample wax is placed in a o-dichlorobenzene in a beaker and placed on a hot plate set at 150° C., to dissolve the sample. The resultant sample solution at a concentration of 0.15 wt. % is placed in a filter unit heated in advance and then set in the GPC apparatus to provide a GPC sample after passing through the filter unit.

(8) Particle Size Distribution

Coulter counter Model TA-II or Coulter Multisizer (available from Coulter Electronics Inc.) may be used as an instrument for measurement. For measurement, a 1%-NaCl aqueous solution as an electrolyte solution is prepared by using a reagent-grade sodium chloride (e.g., "Isoton® II", available from Coulter Scientific Japan Co. may be commercially available). To 100 to 150 ml of the electrolyte solution, 0.1 to 5 ml of a surfactant, preferably an alkylbenzenesulfonic acid salt, is added as a dispersant, and 2 to 20 mg of a sample is added thereto. The resultant dispersion of the sample in the electrolyte liquid is subjected to a dispersion treatment for about 1–3 minutes by means of an ultrasonic disperser, and then subjected to measurement of particle size distribution in the range of 2–40 μm by using the above-mentioned apparatus with a 100 micron-aperture to obtain a volume-bias distribution and a number-basis distribution. From the results of the volume-basis distribution, the weight-average particle size (D4) and volume-average particle size (Dv) of the toner may be obtained (while using a central value for each channel as the representative value of the channel).

The following 13 channels are used: 2.00–2.52 μm, 2.52–3.17 μm, 3.17–4.00 μm, 4.00–5.04 μm, 5.04–6.35 μm, 6.35–8.00 μm, 8.00–10.08 μm, 10.08–12.70 μm, 12.70–16.00 μm, 16.00–20.20 μm, 20.20–25.40 μm, 25.40–32.00 μm and 32.00–40.32 μm with the proviso that the upper limit value is not included for each channel.

(9) Dielectric Loss (Tangent) of a Toner

Calculated from a complex dielectric constant measured at a frequency of 100 kHz by using a holder (electrodes) for dielectric measurement ("4284A Precision LCR Meter", made by Hewlett-Packard Corp.) after calibration at frequencies of 1 kHz and 1 kHz.

For measurement, a toner in an amount of 0.5–0.7 g is weighed and molded into a disk-shaped sample of 25 mm in diameter and 0.5–0.9 mm in thickness by applying a pressure of 39200 kPa (400 kg-f/cm$^2$) for 2 min. The sample is set in a viscoelasticity-measurement apparatus ("ARES", made by Rheometrics Scientific F.E.) of which the 25 mm-dia. holder has been replaced with the dielectric measurement holder (electrodes) ("LCR Meter"), and melt-set by heating up to 150° C., followed by cooling down to 25° C. The measurement is performed at a frequency of 100 kHz while constantly applying a load of 0.49–0.98 N (50–100 g) to the sample and heating at a rate of 1° C./min. up to 160° C. The measurement is performed at 15 sec. intervals. The measurement is performed three times by changing the measurement samples for each toner and an average of the three measured values is taken.

(10) OH Value (Hydroxyl Value)

Measured According to JIS K0070

Ca. 0.5 g of a sample is accurately weighed into a 100 ml-volumetric flask, and 5 ml of an acetylating agent is accurately added thereto. Then, the system is heated by dipping into a bath of 100° C. ±5° C. After 1–2 hours, the flask is taken out of the bath and allowed to cool by standing, and water is added thereto, followed by shaking to decompose acetic anhydride. In order to complete the decomposition, the flask is again heated for more than 10 min. by dipping into the bath. After cooling, the flask wall is sufficiently washed with an organic solvent. The resultant liquid is titrated with a N/2-potassium hydroxide solution in ethyl alcohol by potentiometric titration using glass electrodes.

(11) Toner Particle Circularity

Circularity (Ci) of each toner particles is calculated according to the following formula:

Circularity $Ci=L_0/L$ wherein L represents a peripheral length of a projection image (two-dimensional image) of an individual particle, and $L_0$ represents a peripheral length of a circle giving an identical area as the projection image.

The circularity values described herein are based on values measured by using a flow-type particle image analyzer ("FPIA-1000", available from Toa Iyou Denshi K.K.).

The details of the measurement is described in a technical brochure and an attached operation manual on "FPIA-1000" published from Toa Iyou Denshi K.K. (Jun. 25, 1995) and JP-A 8-136439 (U.S. Pat. No. 5,721,433). The outline of the measurement is as follows.

For an actual measurement of circularity by using the FPIA-measurement, 0.1–0.5 ml of a surfactant (preferably an alkylbenzenesulfonic acid salt) as a dispersion aid is added to 100 to 150 ml of water from which impurities have been removed, and ca. 0.1–0.5 g of sample particles are added thereto. The resultant mixture is subjected to dispersion with ultrasonic waves (50 kHz, 120 W) for 1–3 min. to obtain a dispersion liquid containing 12,000–20,000 particles/$\mu$l and the dispersion liquid is subjected to measurement of a circularity distribution with respect to particles having a circle-equivalent diameter (C.E.D.=$L_0/\pi$) in the range of 0.60 $\mu$m to below 159.21 $\mu$m by means of the above-mentioned flow-type particle image analyzer.

A sample dispersion liquid is caused to flow through a flat thin transparent flow cell (thickness=ca. 200 $\mu$m) having a divergent flow path. A strobe and a CCD camera are disposed at mutually opposite positions with respect to the flow cell so as to form an optical path passing across the thickness of the flow cell. During the flow of the sample dispersion liquid, the strobe is flashed at intervals of 1/30 second each to capture images of particles passing through the flow cell, so that each particle provides a two-dimensional image having a certain area parallel to the flow cell. From the two-dimensional image area of each particle, a diameter of a circle having an identical area (an equivalent circle) is determined as a circle-equivalent diameter (CED=$L_0/\pi$. Further, for each particle, a peripheral length ($L_0$) of the equivalent circle is determined and divided by a peripheral length (L) measured on the two-dimensional image of the particle to determine a circularity Ci of the particle according to the above-mentioned formula.

(12) Methanol Wettability ($W_{MeOH}$) of Inorganic Fine Powder

The methanol wettability of inorganic fine powder externally added to a toner can be measured by using a powder wettability tester ("WET-100P", made by K.K. Resuka). For the measurement, 50 ml of pure water (deionized water or commercially available purified water) is placed in a 100 ml-beaker, and 0.2 g of an inorganic fine powder sample is accurately weighed therein. Into the system under stirring, methanol is added dropwise thereto at a rate of 3 ml/min. If the inorganic fine powder begins to sink and be dispersed in the aqueous solution, the transmittance through the solution is lowered, and the amount of added methanol (ml) up to that time is measured as a methanol wettability.

EXAMPLES

Hereinbelow, the present invention will be described more specifically based on Examples, which however should not be construed to restrict the scope of the present invention in any way.

Modified Waxes

Some of base waxes having characteristics as shown in the following Table 2 were modified to produce modified waxes.

TABLE 2

| Base waxes | | | | |
|---|---|---|---|---|
| Name | Type | Tabs*2 | Mp*3 | Mw/Mn |
| Wax (a) | polyethylene | 94 (° C.) | 810 | 1.2 |
| Wax (b) | Fischer-Tropsche | 106 (° C.) | 970 | 1.5 |
| Wax (c) | long chain*1 alkyl alcohol | 100 (° C.) | 860 | 1.8 |
| Wax (d) | polypropylene | 148 (° C.) | 4100 | 9.2 |

*1Having an alkyl group of averagely 40 carbon atoms.
*2Heat-absorption peak temperature.
*3Peak-molecular weight

Production Example 1

Into 200 wt. parts of xylene, 100 wt. parts of Wax (b) (Fischer-Tropsche wax) was added, and the mixture was heated to 110° C. under stirring. Into the mixture being aerated with nitrogen, 3 wt. parts of styrene monomer and 0.8 wt. part of 2,2'-bis(4,4-di-t-butylperoxycyclohexyl) propane (polymerization initiator, were added dropwise in 1 hour. After the addition, the system was further stirred for 3 hours and heated to a reflux temperature. Thereafter, the solvent xylene was distilled off under a reduced pressure to obtain Modified wax (W-1), which exhibited a peak molecular weight (Mp) of 950, a ratio Mw/Mn of 25, and a heat-absorption peak temperature (Tabs) of 97° C.

The characteristics of Modified wax (W-1) are summarized in Table 3 together with those of modified waxes obtained in the following Production Examples.

Production Examples 2–8

Modified waxes (W-2) to (W-8) were obtained in the same manner as in Production Example 1 except for using laser waxes and wax-modifying monomers as shown in Table 3.

TABLE 3

| Modified wax | | | | | | | | |
|---|---|---|---|---|---|---|---|---|
| | | Modifying monomers*1 (wt.parts) | | | | Modified wax properties | | |
| Modified wax | Base wax | Sty | MBM | MAH | PE | Mg | Mw/Mn | Tabs. (° C.) |
| W-1 | (b) | 35 | — | — | — | 950 | 2.5 | 103 |
| W-2 | (b) | 60 | — | — | — | 930 | 3.1 | 101 |
| W-3 | (b) | 15 | — | — | — | 970 | 2.3 | 104 |
| W-4 | (b) | 35 | 5 | — | — | 930 | 3.4 | 99 |
| W-5 | (b) | 35 | 5 | — | 5 | 880 | 4.7 | 96 |
| W-6 | (a) | — | — | 30 | — | 710 | 5.7 | 86 |
| W-7 | (a) | 35 | 5 | — | — | 760 | 2.6 | 96 |
| W-8 | (a) | — | 20 | — | — | 740 | 2.4 | 92 |

*1: Sty = styrene
MBM = monobutyl maleate
MAH = maleic anhydride
PE = polyester

Binder Resins

Production Example 1

An unsaturated polyester (1) (acid value (Av)=22 mgKOH/g, hydroxyl value (OHv)=34 mgKOH/g, peak molecular weight (Mp)=9000, glass transition temperature (Tg)=53° C.) was prepared from 30.5 mol. % of terephthalic acid, 3.5 mol. % of fumaric acid, 13 mol. % of trimellitic acid, 15 mol. % of alkenylsuccinic acid (having alkenyl groups of averagely 12 carbon atoms), 24 mol. % of bisphenol A derivative represented by the above-mentioned formula (2) (R=ethylene group, x+y=2.4) and 24 mol. % of bisphenol A derivative represented by the formula (2) (R=propylene group, x+y=2.2). Separately, a saturated polyester (Av=20 mgKOH/g, OHv=33 mgKOH/g, Mp=9300, Tg=54° C.) was prepared from 34 mol. % of terephthalic acid, 13 mol. % of trimellitic acid, 15 mol. % o alkenylsuccinic acid (having alkenyl groups of averagely 12 carbon atoms), 24 mol. % of bisphenol A derivative represented by the above-mentioned formula (2) (R=ethylene group, x+y=2.4) and 24 mol. % of bisphenol A derivative represented by the formula (2) (R=propylene group, x+y=2.2).

In a reaction vessel equipped with a reflux pipe, a stirrer, a thermometer a nitrogen intake pipe, a dropping device and a reduced pressure device, 25 wt. parts of the unsaturated polyester (1), 75 wt. parts of the saturated polyester and 9.5 wt. parts of Modified wax (W-1) were mixed together with 200 wt. parts of xylene, and a monomer mixture for providing a vinyl polymer unit comprising 73 wt. parts of styrene, 21 wt. parts of butyl acrylate, 6 wt. parts of monobutyl maleate and 2 wt. parts of di-t-butyl peroxide (polymerization initiator) was added thereto to effect 8 hours of radical polymerization at a xylene-reflux temperature, thereby forming a solution mixture containing Hybrid resin (1) formed by grafting a vinyl polymer onto the unsaturated polyester, the saturated polyester and the vinylpolymer.

Thereafter, the xylene was distilled off under a reduced pressure to obtain a resin composition principally comprising Hybrid resin (1) prepared above, Hybrid resin (2) formed by an ester reaction of a hydroxyl group in Hybrid resin (1) with a carboxylic acid or acid anhydride formed by elimination of butanol from the butyl acrylate and the monobutyl maleate constituting the vinyl polymer unit, Hybrid resin (3) formed by an ester reaction of the saturated polyester and the vinyl polymer similarly as the formation of Hybrid resin (2), and Modified wax (W-1). This resin composition (referred to as Hybrid resin composition (HB-1)) exhibited Mp=11000, Tg=55° C., Av=17 mgKOH, OHv=14 mgKOH/g and a THF-insoluble content (TFHins) of ca. 28 wt. %.

Production Examples 2–8

Hybrid resin compositions (HB-2) to (HB-8) were prepared in the same manner as in Production Example 1 except for using Modified waxes (W-2) to (W-8), respectively, instead of Modified wax (W-1).

Production Example 9

Hybrid resin composition (HB-9) was prepared in the same manner as in Production Example 1 except for omitting Modified wax (W-1).

Production Example 10

In a reaction device similar to the one used in Production Example 1, 200 wt. parts of xylene was placed, and a monomer composition comprising 80 wt. parts of styrene, 18 wt. parts of butyl acrylate, 1.5 wt. parts of monobutyl maleate, 0.5 wt. part of divinylbenzene and 2.0 wt. parts of di-t-butyl peroxide (polymerization initiator) was added thereto and subjected to 12 hours of polymerization at a reflux temperature under nitrogen stream. Then, the xylene was distilled off under a reduced pressure to obtain a vinyl polymer exhibiting Mw=$2.8\times10^5$, Mw/Mn=27.3 and Av=2.3 mgKOH/g.

Production Example 11

26 mol. % of terephthalic acid, 7 mol. % of trimellitic anhydride, 16 mol. % of dodecenylsuccinic acid and 45 mol. % of bisphenol A derivative of the above-mentioned formula (2), were reacted to prepare a polyester resin, which exhibited Mw=$8.7\times10^4$, Mw/Mn=13.5, and Av=10.1 mgKOH/g.

Production Example 12

Hybrid resin composition (HB-10) was prepared in the same manner as in Production Example 1 except for adding 9.5 wt. parts of Wax (c) shown in Table 2 instead of Modified wax (W-1).

Production Example 13

Hybrid resin composition (HB-11) was prepared in the same manner as in Production Example 1 except for adding 9.5 wt. parts of Wax (d) shown in Table 2 instead of Modified wax (W-1).

Example 1

Hybrid resin composition (HB-1) 104.5 wt.parts

Charge control agent 2 wt.parts (organic iron compound formed of 2 mol of the monoazo compound of the formula (4) and 1 mol of iron)

Magnetic material 90 wt.parts (D1=0.18 $\mu$m, Hc=9.6 kA/m, $\sigma$s=83 $Am^2/kg$, or=15 $Am^2/kg$)

The above ingredients were melt-kneaded by a twin-screw extruder heated at 130° C. After being cooled, the kneaded product was coarsely crushed by a cutter mill to obtain Powdery feed (1) containing 97 wt. % of 18 mesh-pass and 92 wt. % of 100 mesh-on.

Powdery feed (1) was then subjected to pulverization and classification in an apparatus system having an organization as shown in FIG. 6. A mechanical pulverizer 201 ("Turbomill T-250", made by Turbo Kogyo K.K.) including a rotor 314 and a stator 30 (shown in FIGS. 8 and 9) with a gap of 1.5 mm therebetween was operated at a peripheral speed of the rotor 314 of 115 mm/sec.

In this Example, the powdery feed was supplied for pulverization at a rate of 40 kg/h to the mechanical pulverizer 201 via a table-type first metering feeder 215. The pulverized feed from the mechanical pulverizer 201 was accompanied with suction air to be collected by a cyclone 229 and introduced to a second metering feeder 262. The inlet temperature and the outlet temperature of the mechanical pulverizer 201 were −10° C. and 46° C., respectively, giving a temperature difference ΔT therebetween of 56° C. The pulverizate from the mechanical pulverizer 201 exhibited D4=7.1 $\mu$m and a sharp particle size distribution as represented by 28% by number of particles of at most 4.0 $\mu$m and 2.8% by volume of particles of at least 10.1 $\mu$m.

The pulverizate from the mechanical pulverizer 201 was then supplied at a rate of 44 kg/h via the second metering feeder 262, a vibration feeder 263 and a feed supply nozzle 276 to a multi-division pneumatic classifier 61 having a structure shown in FIG. 10, where the pulverized feed was classified into three fractions of a coarse powder, a medium powder and a fine powder. For the classification, the pulverized feed was introduced into the classifier 61 by utilizing a gas stream through a feed supply nozzle 76 caused by evacuation through at least one of discharge ports 71, 72 and 73, and also a compressed air ejected out of a high-pressure air supply nozzle 96. The thus-introduced pulverized feed was classified into coarse powder G, medium powder M-1 and fine powder.

The coarse powder G was collected by a cyclone 266 and recycled to the mechanical pulverizer 201 at a rate of 2.0 kg/h for re-pulverization.

Medium powder M-1 was recovered at classification yield (ratio of the medium powder to the total powdery feed) of 88%.

Medium powder (M-1) in 100 wt. parts was blended with 1.0 wt. part of hydrophobic silica fine powder (BET specific surface area ($S_{BET}$)=300 $m^2/g$, methanol wettability ($W_{MeOH}$)=92%) by a Henschel mixer to obtain Toner 1 of the present invention.

Toner 1 exhibited D4=7.6 μm, a sharp particle size distribution as represented by 8.5% by volume of particles of at least 10.1 μm and contained 77% by number of particles showing a circularity (Ci) of at least 0.950 (Ci≧0.950). Further, Toner 1 exhibited a dielectric loss tangent (tan δ) characteristic showing a maximum (tanδ.max) of $7.6\times10^{-2}$ at 112° C. and a DSC heat-absorption peak temperature (Tabs.) of 103° C. Physical properties of Toner 1 are summarized in Table 1 together with those of toners prepared in the following Examples.

Toner 1 was subjected to evaluation of image forming performances by continuous image formation on $10^5$ sheets in each of normal temperature/normal humidity environment (23° C./55% RH), normal temperature/low humidity environment (23° C./5% RH) and high temperature/high humidity environment (30° C./80% RH) by using a commercially available copying machine ("NP-6085", made by Canon K.K.) including a hot-roller fixation device operated at a fixing temperature of 185° C. and at a process speed of ca. 500 mm/s. The results of evaluation are shown in Table 5 together with those of the following Examples.

Example 2

Toner 2 was prepared and evaluated in the same manner as in Example 1 except that the rotor 314 of the mechanical pulverizer was operated at a peripheral speed of 124 mm/sec. Toner 2 exhibited D4=6.8 μm, contained 3.0% by volume of particles of at least 10.1 μm and contained 81.9% by number of particles of Ci≧0.950.

Example 3

Toner 3 was prepared and evaluated in the same manner as in Example 1 except that the rotor 314 of the mechanical pulverizer was operated at a peripheral speed of 105 mm/sec. Toner 3 exhibited D4=9.3 μm, contained 30.6% by volume of particles of at least 10.1 μm and contained 72.1% by number of particles of Ci≧0.950.

Examples 4–10

Toners 4 to 10 were prepared and evaluated in the same manner as in Example 1 except for using Hybrid resin compositions (HB-2) to (HB-8), respectively, instead of Hybrid resin composition (HB-1).

Example 11

Toner 11 was prepared and evaluated in the same manner as in Example 1 except for replacing Hybrid resin composition (HB-1) with 100 wt. parts of Hybrid resin composition (HB-9) and 9.5 wt. parts of Modified wax (W-1).

Comparative Example 1

Comparative medium powder (RM-1) was prepared in the same manner as in Example 1 except for using 109.5 wt. parts of Hybrid resin composition (HB-10) instead of Hybrid resin composition (HB-1). Comparative medium powder (RM-1) contained a large amount of fine particles (assumed to have particle sizes of below 1 μm) not separatable by the classification step. As a result of observation through a scanning electron microscope, a large amount of fine particles assumed to comprise a magnetic material were observed.

By using Comparative medium powder (RM-1) instead of Medium powder (M-1) to be blended with the same hydrophobic silica fine powder as in Example 1, Comparative toner 1 was prepared. Comparative toner 1 exhibited D4=7.1 μm, contained 22.3% by volume of particles of at least 10.1 μm, and contained 67% by number of particles of Ci≧0.950. Toner 1 also exhibited tanδ.max=$2.3\times10^{-2}$ at 106° C. and Tabs.=100° C.

Comparative toner 1 was evaluated in the same manner as in Example 1 and the results are also shown in Table 1 together with those of the following Comparative Examples.

Comparative Example 2

Comparative toner 2 was prepared and evaluated in the same manner as in Example 1 except for using 109.5 wt. parts of Hybrid resin composition (HB-11) instead of Hybrid resin composition (HB-1). Comparative toner 2 exhibited tanδ.max=$5.3\times10^{-2}$ at 109° C. and Tabs.=144° C.

Comparative Example 3

Figure 11:
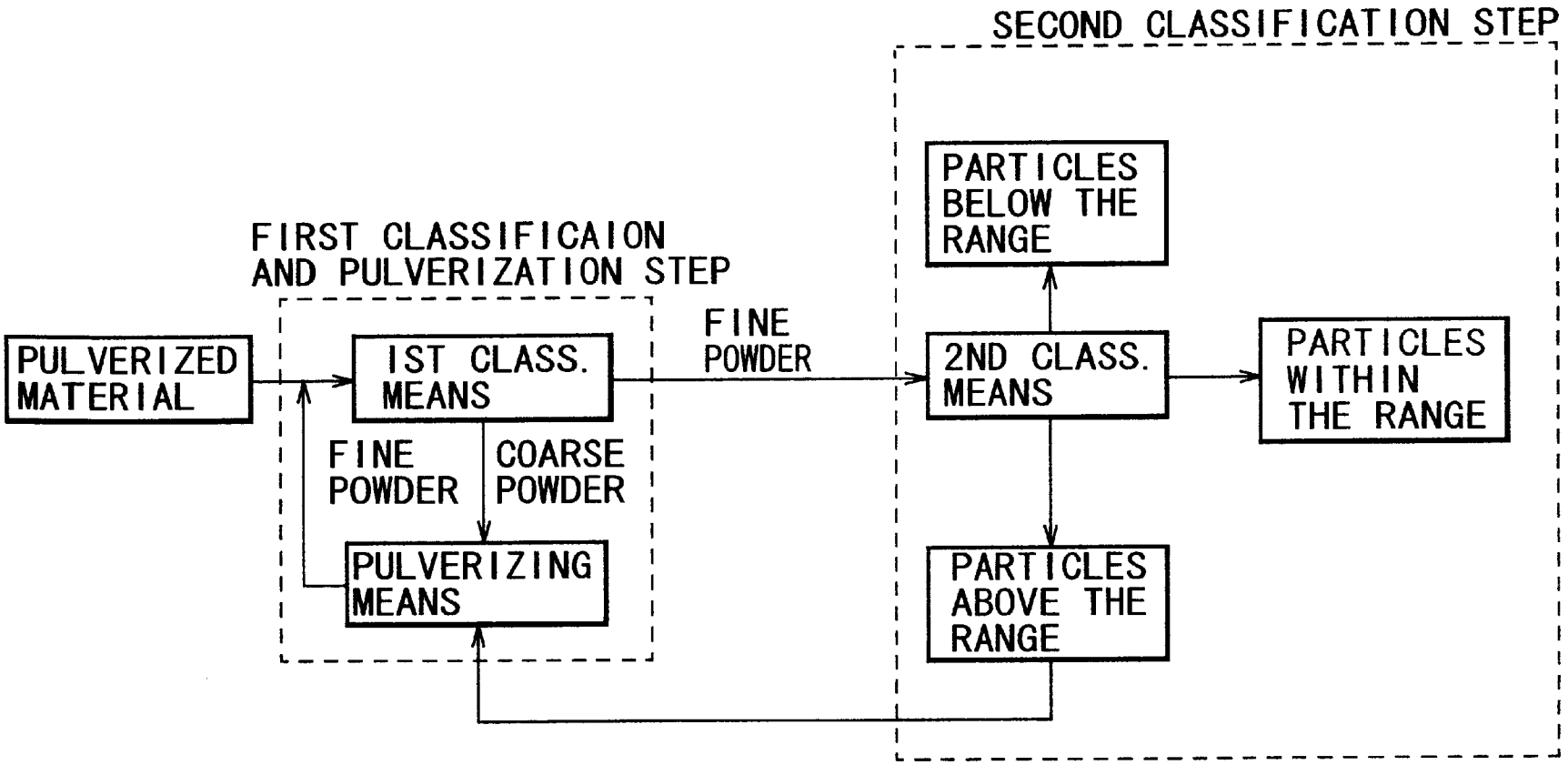
FIG. 11 is a flow chart for illustrating a conventional toner production process.
Figure 12:
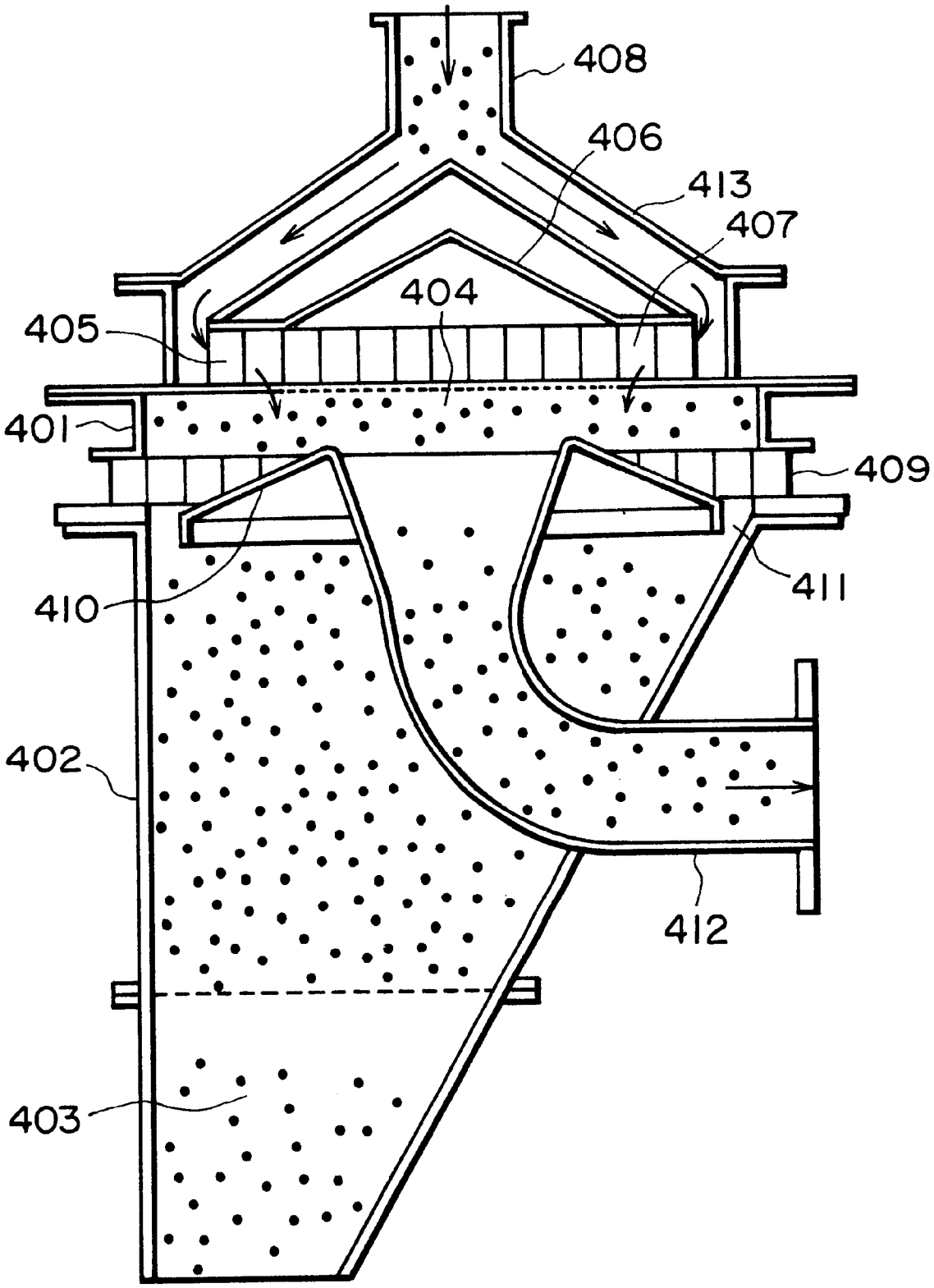
FIG. 12 is a schematic sectional view of an example of classifier used as a first classification means used in a conventional toner production process.
Figure 13:
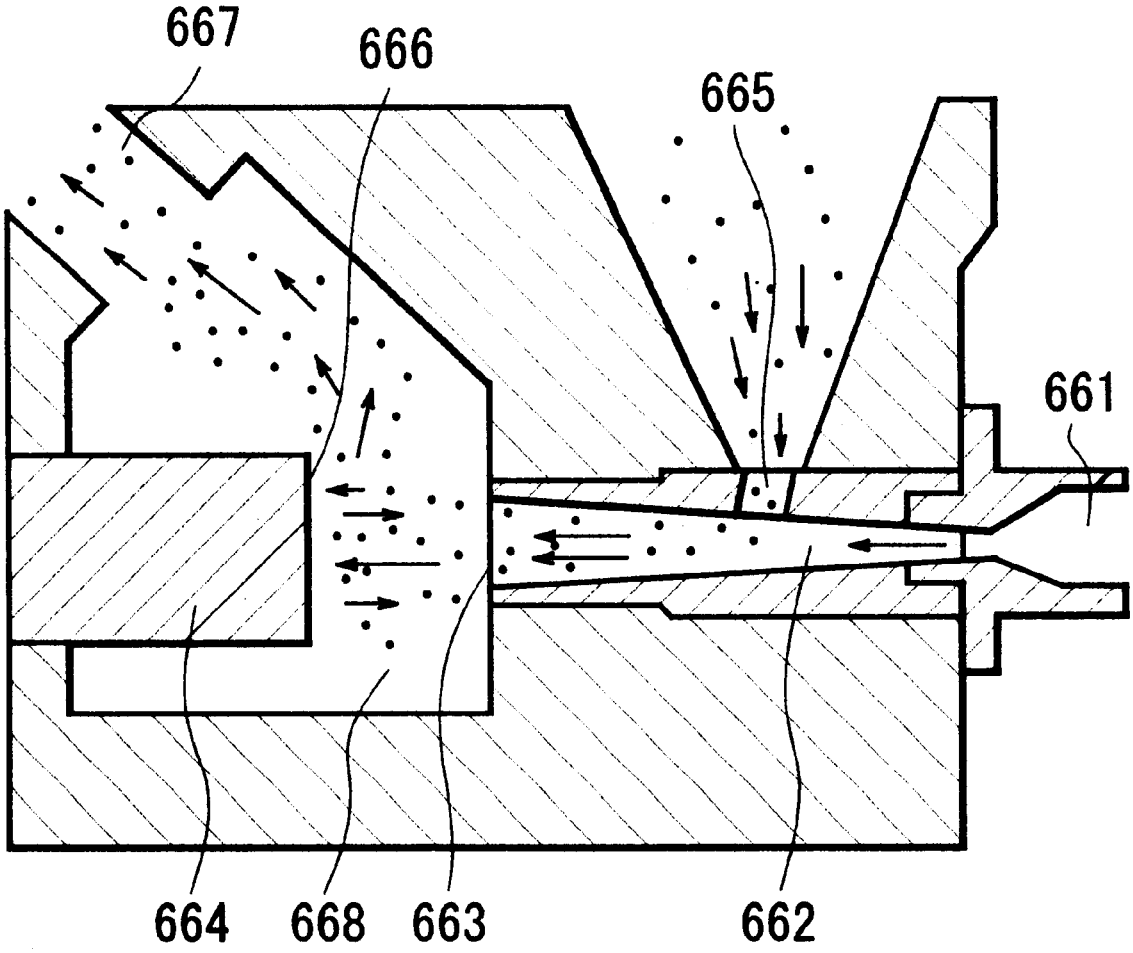
FIG. 13 is a schematic sectional view of a conventional impingement-type pneumatic pulverizer.

Comparative toner 3 was prepared in a similar manner as in Example 1 but by subjecting Powdery feed (1) to pulverization and classification in a system shown in FIG. 11 and including an impingement-type pneumatic pulverizer shown in FIG. 13 as the pulverizing means in addition to a first classification means having an organization shown in FIG. 12 and a second classification means having an organization shown in FIG. 10.

To supplement the apparatus organization; in the impingement-type pneumatic pulverizer shown in FIG. 13, an impingement member 664 is disposed opposite to an outlet port 663 of an acceleration pipe 662 connected to a high-pressure gas feed nozzle 661, a powdery material is sucked through a powder material feed port 665 formed intermediate the acceleration tube 662 into the acceleration tube 662 under the action of a high-pressure gas supplied to the acceleration pipe, and the powder material is ejected from the outlet port 663 together with the high-pressure gas to impinge onto the impinging surface 666 of the impingement member 664 to be pulverized under the impact. The pulverized product is discharged out of a discharge port 667.

The classification apparatus shown in FIG. 12 includes a tubular main casing 401 and a lower casing 402, to a lower part of which is connected a hopper 403 for discharging coarse powder. Inside the main casing 401, a classifying chamber 404 is formed and defined by an annular guide chamber 405 and a conical (or umbrella-shaped) upper cover 406 having a highest portion at its center.

A plurality of louvers 407 are arranged at a partitioning wall between the classifying chamber 404 and the guide chamber 405 so as to introduce therethrough a powdery material and air introduced into the guide chamber 405 to the classifying chamber 404 as a whirling stream.

The upper part of the guide chamber 405 comprises a space between a conical upper casing 413 and the conical upper cover 406. At a lower part of the main casing 401, classifying louvers 409 are arranged in a circumferential direction so as to introduce therethrough a classifying air entering from outside into the classifying chamber as a whirling stream. At a bottom part of the classifying chamber 404, a conical umbrella-shaped classifying plate 410 having a higher portion at its center is disposed, and surrounding the classifying plate 410, a coarse powder discharge port is disposed. At the central part of the classifying plate 410, a fine powder discharge chute 412 is connected having a lower end bent in a character L-shape and projected out of the side wall of the lower casing 402. The chute 412 is connected to a suction fan via a fine powder recovery means such as a cyclone or a dust collector, so that the suction air is introduced by the suction fan through the louvers 409 into the classifying chamber to cause a whirling stream required for the classification.

In operation, a coarsely crushed product for toner production together with conveying air is introduced through a feed tube 408 into the guide chamber 405, is passed through the louvers 407 and enters the classifying chamber 404 at a uniform density while causing a whirling stream.

The whirling coarsely crushed product stream having entered the classifying chamber 404 enhances its whirling by the action of a suction air caused by the suction fan connected to the fine powder discharge chute 413 and passing through the classifying louvers 409 below the classifying chamber 404, whereby the coarsely crushed powder is separated by a centrifugal force acting on the individual particles into coarse powder and fine powder. The coarse powder whirling as an outer stream within the classifying chamber 404 is discharged through the coarse powder discharge port 411 and the lower hopper 403 to be discharged out of the apparatus and recycled to the pulverizing means.

On the other hand, the fine powder moving along the upper slope of the classifying plate 410 toward the center is discharged through the fine powder discharge chute 412. The discharged fine powder is further classified into the second classifying means to provide medium powder recovered as a toner.

Comparative medium powder (RM-1) was thus obtained by pulverization and classification by the system of FIG. 11 and was blended with the same hydrophic silica fine powder as used in Example 1 to obtain Comparative toner 3. Comparative toner 3 exhibited D4=7.8 μm, contained 5.3% by volume of particles of at least 10.1 μm, and contained 62% by number of particles of Ci≧0.950. Comparative toner 3 further exhibited tanδ.max=$4.9\times10^{-2}$ at 110° C. and Tabs.=103° C.

Comparative Example 4

Comparative medium powder (RM-3) prepared in Comparative Example 3 was surface-treated by using an impact-type surface treatment apparatus (as disclosed in U.S. Pat. No. 6,033,817) to provide Comparative medium powder (RM-4).

Comparative toner 4 was prepared and evaluated by using Comparative medium powder (RM-4) instead of medium powder (M-1) otherwise in the same manner as in Example 1. Comparative toner 4 exhibited D4=7.8 μm, contained 22% by number of particles of at most 4.0 μm and 7.9% by volume of particles of at least 10.1 μm, and contained 78.9% by number of particles of Ci≧0.950. Comparative toner 4 also exhibited tanδ.max=$4.4\times10^{-2}$ at 129° C. and Tabs.=103° C.

Comparative Example 5

Comparative toner 5 was prepared and evaluated in the same manner as in Example 1 except for using the vinyl copolymer prepared in Production Example 10 instead of hybrid resin composition (HB-1).

Comparative Example 6

Comparative toner 6 was prepared and evaluated in the same manner as in Example 1 except for using the polyester resin prepared in Production Example 11 instead of Hybrid resin composition (HB-1).

TABLE 4

Toner properties

| Example | Tabs. (° C.) | tan δ max ($\times10^{-2}$) | tan δ Temp. (° C.) | Particle size distribution $D_4$ (μm) | Particle size distribution Vol. % of D ≧ 10.1 μm | N % of Ci ≧ 0.950 | Mp | Mz/Mw | wf. % of Mw ≧ $10^4$ | Av (mgKOH/g) | THF-insoluble (wt. %) | Wax dispersion** |
|---|---|---|---|---|---|---|---|---|---|---|---|---|
| 1 | 103 | 7.6 | 112 | 7.6 | 7.5 | 77.7 | 9800 | 298 | 8 | 9 | 28 | A |
| 2 | 103 | 7.6 | 114 | 6.8 | 3.0 | 81.9 | 9800 | 298 | 8 | 9 | 28 | A |
| 3 | 103 | 6.7 | 111 | 9.3 | 30.6 | 72.1 | 9800 | 298 | 8 | 9 | 28 | A |
| 4 | 106 | 6.2 | 119 | 7.6 | 8.2 | 77.5 | 9800 | 298 | 8 | 9 | 28 | A |
| 5 | 102 | 7.0 | 101 | 7.6 | 7.6 | 75.3 | 9800 | 298 | 8 | 9 | 28 | B |
| 6 | 99 | 7.1 | 105 | 7.8 | 8.4 | 75.4 | 9800 | 165 | 7 | 10 | 32 | B |
| 7 | 96 | 8.3 | 105 | 7.8 | 9.0 | 74.6 | 9800 | 160 | 7 | 10 | 32 | B |
| 8 | 86 | 6.2 | 94 | 7.6 | 8.0 | 76.6 | 9600 | 90 | 5 | 11 | 39 | B |
| 9 | 96 | 6.3 | 101 | 7.8 | 8.5 | 76.2 | 9600 | 880 | 13 | 12 | 46 | B |
| 10 | 92 | 7.9 | 99 | 7.8 | 6.9 | 83.3 | 9600 | 360 | 9 | 11 | 22 | A |
| 11 | 103 | 9.1 | 106 | 7.4 | 8.0 | 77.1 | 9800 | 298 | 8 | 9 | 28 | B |
| Comp. 1 | 100 | 2.3 | 106 | 7.1 | 22.3 | 67.0 | 9800 | 298 | 8 | 9 | 28 | D |
| Comp. 2 | 144 | 5.3 | 109 | 8.0 | 20.7 | 66.3 | 9800 | 298 | 8 | 9 | 28 | B |
| Comp. 3 | 103 | 4.9 | 110 | 7.8 | 5.3 | 62.0 | 9800 | 298 | 8 | 9 | 28 | C |
| Comp. 4 | 103 | 4.4 | 129 | 7.8 | 7.9 | 78.2 | 9800 | 298 | 8 | 9 | 28 | C |
| Comp. 5 | 103 | 2.4 | 127 | 11.2 | 61.4 | 63.3 | 19000 | 24 | 13 | 0.8 | 2 | D |
| Comp. 6 | 103 | 10.8 | 103 | 6.6 | 9.3 | 67.4 | 7400 | 5 | 1 | 4 | 0 | E |

**Remarks are added after Table 5.

TABLE 5

| | Toner performances | | | | | | | | | | |
|---|---|---|---|---|---|---|---|---|---|---|---|
| | 23° C./55% RH | | | 30° C./85% RH | | | 23° C./5% RH | | 23° C./55% RH | | |
| | I. D. | | Toner | I. D. | | | Fog | | | anti- | Anti-block |
| Example | initial | final | attachment | initial | final | after 2 days' standing | initial | final | Fixability | offset | (50° C., 5 days) |
| 1 | 1.44 | 1.46 | A | 1.42 | 1.43 | 1.37 | A | B | A | B | A |
| 2 | 1.46 | 1.48 | A | 1.43 | 1.44 | 1.36 | A | B | A | B | A |
| 3 | 1.42 | 1.42 | A | 1.40 | 1.39 | 1.38 | A | B | A | B | A |
| 4 | 1.39 | 1.38 | B | 1.39 | 1.37 | 1.37 | B | B | B | B | A |
| 5 | 1.42 | 1.37 | B | 1.42 | 1.40 | 1.35 | B | B | A | B | B |
| 6 | 1.44 | 1.40 | A | 1.44 | 1.41 | 1.39 | B | A | A | A | B |
| 7 | 1.44 | 1.38 | B | 1.44 | 1.42 | 1.39 | B | B | A | B | B |
| 8 | 1.40 | 1.37 | B | 1.40 | 1.37 | 1.35 | B | A | A | A | B |
| 9 | 1.42 | 1.44 | B | 1.42 | 1.38 | 1.37 | B | B | A | B | B |
| 10 | 1.44 | 1.45 | A | 1.41 | 1.42 | 1.39 | A | B | A | B | A |
| 11 | 1.42 | 1.37 | B | 1.42 | 1.41 | 1.33 | B | A | B | A | A |
| Comp. 1 | 1.40 | 1.30 | D | 1.40 | 1.41 | 1.27 | D | B | B | D | B |
| Comp. 2 | 1.31 | 1.21 | D | 1.31 | 1.30 | 1.04 | B | C | E | C | B |
| Comp. 3 | 1.35 | 1.34 | B | 1.32 | 1.34 | 1.24 | C | C | C | C | B |
| Comp. 4 | 1.39 | 1.38 | C | 1.35 | 1.29 | 1.16 | C | D | C | C | B |
| Comp. 5 | 1.32 | 1.17 | D | 1.20 | 1.14 | 0.91 | E | D | D | D | A |
| Comp. 6 | 1.22 | 1.09 | D | 1.07 | 0.88 | 0.76 | D | D | D | E | A |

Wax dispersion in Table 4 was evaluated in the following manner.

A toner sample was observed through an optical microscope (at a magnification 30–100) equipped with a polarizer, and the number of shining spots (each representing an isolated wax particle) was counted per 500 toner particles. Base on the number of shining spots, the evaluation was performed according to the following standard.

A: no shining spots

B: 1–10 spots (practically of no problem)

C: 11–20 spots (resulting in some fog)

D: 21–30 spots (resulting in wax attachment on the photosensitive drum)

E: more than 30 spots (resulting in attachment of both wax and toner on the photosensitive drum)

The results of toner performances shown in Table 5 are based on evaluation methods and standards described below.

(1) I.D. (Image Density)

Image density was measured at the initial stage and final stage of the continuous image formation on $10^5$ sheets and additionally at an initial stage after standing for 2 days after the continuous image formation test in some cases, as a reflection density of a 5 mm-dia. circle image by using a Macbeth densitometer (made by Macbeth Co.) with an SPI filter.

(2) Toner Attachment

After the continuous image formation on $10^5$ sheets in the environment of 23° C./55% RH, toner attachment onto the fixing member was observed with eyes and correlated with soiling on the recorded images. The evaluation was performed according to the following standard.

A: No toner attachment at all.

B: Slightly observed but practically acceptable.

C: Easily recognizable with eyes.

D: Remarkable attachment.

E: Toner attachment also observed on the front or rear surface of the recording sheet.

(3) Fog

The whiteness (reflectance) was measured at white ground portions of blank white paper and the paper after image formation by using a reflectometer ("MODEL TC-6DS", made by Tokyo Denshoku K.K.), and the evaluation was performed based on a fog density (%) determined as a difference in the measured whiteness values according to the following standard. The fog evaluation was performed at an initial stage and a final stage during the continuous image formation in the environment of 23° C./5% RH.

A: Below 3%

B: 3 to below 5%

C: 5 to below 7%

D: 7 to below 10%

E: 10% or higher (4) Fixability

A fixed toner image at a halftone image density of 0.8 formed after the continuous image formation in the environment of 23° C./55% RH was rubbed with lens cleaning paper for 5 reciprocations under load of 50/cm$^2$, and the density lowering (%) by the rubbing is measured and evaluated according to the following standard.

A: Below 5%

B: 5 to below 10%

C: 10 to below 15%

D: 15 to below 20%

E: 20% or higher (5) Anti-Offset

The occurrence of hot-temperature offset was evaluated at the time of image formation after the continuous image formation by observation of the fixing roller surface and traces on the recorded paper. The evaluation was performed according to the following standard.

A: No occurrence at all.

B: Slightly occurred but at a practically acceptable level.

C: Easily recognizable with eyes.

D: Noticeable offset occurred.

E: Paper winding about the fixing roller.

(6) Anti-Block 10 g of a sample toner was placed in a 100 cc-plastic cup and left to stand for 5 hours in a thermostat vessel controlled at 50° C. The flowability of the cup after the standing was observed with eyes and compared with that before the standing. The evaluation was performed according to the following standard.

A: No change in flowability at all.

B: Slightly inferior flowability before the standing.

C: Partial agglomerate observed at an easily collapsile level.

D: Wholly agglomerated but easily collapsible.

E: Wholly agglomerated and not easily collapsible.

What is claimed is:

1. A toner comprising:

at least a binder resin, a colorant and a wax, wherein (a) the toner exhibits a dielectric loss tangent showing a maximum of $6.0\times10^{-2}$ to $10.0\times10^{-2}$ in a temperature range of 90 to 125° C., (b) the toner provides a DSC curve showing at least one heat-absorption peak or shoulder in a temperature range of 85 to 140° C. on temperature increase according to differential scanning calorimetry (DSC), and (c) the binder resin comprises a hybrid resin having a vinyl polymer unit and a polyester unit.

2. The toner according to claim 1, wherein the maximum of dielectric loss tangent occurs in a temperature range of 95 to 120° C.

3. The toner according to claim 1, wherein the maximum of dielectric loss tangent occurs in a temperature range of 100 to 115° C.

4. The toner according to claim 1, wherein the maximum of dielectric loss tangent is in a range of $6.5\times10^{-2}$ to $9.0\times10^{-2}$.

5. The toner according to claim 1, wherein the maximum of dielectric loss tangent is in a range of $6.9\times10^{-2}$ to $8.0\times10^{-2}$.

6. The toner according to claim 1, wherein the DSC curve of the toner shows at least one heat-absorption peak or shoulder in a temperature range of 90–135° C.

7. The toner according to claim 1, wherein the DSC curve of the toner shows at least one heat-absorption peak or shoulder in a temperature range of 95–130° C.

8. The toner according to claim 1, wherein the toner contains toner particles of at least 3 $\mu$m including at least 70% by number of particles having a circularity (Ci) of at least 0.950.

9. The toner according to claim 1, wherein the toner contains toner particles of at least 3 $\mu$m including 70 to 95% by number of particles having a circularity (Ci) of at least 0.950.

10. The toner according to claim 1, wherein the toner has an acid value of 1 to 30 mgKOH/g.

11. The toner according to claim 1, wherein the binder resins has a THF-(tetrahydrofuran)-insoluble matter in a proportion of 5 to 60 wt. % thereof.

12. The toner according to claim 1, wherein the binder resins has a THF-(tetrahydrofuran)-insoluble matter in a proportion of 10 to 50 wt. % thereof.

13. The toner according to claim 1, wherein the binder resin contains a THF (tetrahydrofuran)-soluble matter providing a chromatogram by gel permeation chromatography (GPC) showing a main peak in a molecular weight range of 3000 to 15000 and a ratio (Mz//Mw) of 30 to 1000 between z-average molecular weight (Mz) and weight-average molecular weight (Mw).

14. The toner according to claim 1, wherein the toner contains a charge control agent.

15. The toner according to claim 14, wherein the charge control agent is an organic aluminum compound or an organic iron compound.

16. The toner according to claim 1, wherein the wax comprises hydrocarbon wax, polyethylene wax or polypropylene wax.

17. The toner according to claim 1, wherein the wax has been modified with styrene, monobutyl maleate or maleic anhydride.

18. The toner according to claim 1, wherein the toner has a weight-average particle size of 4 to 10 $\mu$m and contains below 50% by volume of particles of 10.1 $\mu$m or larger.

19. The toner according to claim 1, wherein the toner contains a flowability-improving agent having a BET specific surface area of at least 30 $m^2/g$ as an external additive.

20. The toner according to claim 1, wherein the toner contains a flowability-improving agent having a methanol wettability of at least 30% as an external additive.

21. The toner according to claim 1, wherein the toner contains a flowability-improving agent having a BET specific surface area of at least 30 $m^2/g$ and a methanol wettability of at least 30% as an external additive.

22. The toner according to claim 1, wherein the toner is a magnetic toner.

23. An image forming apparatus, comprising:

(I) a developing step of developing an electrostatic image carried on an image-bearing member with a toner to form a toner image;;

(II) a transfer step of transferring the toner image on the image-bearing member onto a recording material via or without via an intermediate transfer member; and (III) a fixing step of heat-fixing the toner image onto the recording material;

wherein the toner is a toner according to any one of claims 1 to 22.

24. A process-cartridge detachably mountable to a main assembly of an image forming apparatus for forming a toner image by developing an electrostatic latent image formed on an image-bearing member, wherein said process-cartridge includes (i) an image-bearing member, (ii) a developing means for developing an electrostatic latent image carried on the image-bearing member with a toner to form a toner image on the image-bearing member, and (iii) at least one means selected from the group consisting of a charging means for charging the image-bearing member, a latent image-forming means for forming the electrostatic latent image on the image-bearing member, a transfer means for transferring the toner image onto a recording material, and a cleaning means for removing a portion of toner remaining on the image-bearing member after transfer of the toner image onto the recording material, and the toner is a toner according to any one of claims 1 to 22.

* * * * *

UNITED STATES PATENT AND TRADEMARK OFFICE

CERTIFICATE OF CORRECTION

PATENT NO. : 6,613,490 B2
DATED : September 2, 2003
INVENTOR(S) : Satoshi Matsunnaga et al.

It is certified that error appears in the above-identified patent and that said Letters Patent is hereby corrected as shown below:

Drawings,
Figure 7, “COLLIG WATER” should read -- COOLING WATER --.

Column 2,
Line 25, “impart” should read -- imparting --.

Column 4,
Line 17, “without via” should read -- without --.

Column 5,
Line 2, “classification-step” should read -- classification step --; and
Line 36, “of the” should be deleted.

Column 13,
Line 28, “particularly” should read -- particularly preferred --.

Column 17,
Line 20, “Example” should read -- Examples --; and
Line 59, “via (second occurrence) should be deleted.

Column 19,
Line 34, “subjected” should read -- subjected to --.

Column 22,
Line 47, “provide” should read -- provided --.

Column 25,
Line 11, “e” should read -- be --; and
Line 35, “discharge” should read -- discharged --.

Column 30,
Line 22, “initiator,” should read -- initiator) --.

Column 31,
Line 9, “o” should read -- of --; and
Line 58, “was” should read -- were --.

Column 37,
Line 21, “Bas” should read -- Based --.

UNITED STATES PATENT AND TRADEMARK OFFICE

CERTIFICATE OF CORRECTION

PATENT NO. : 6,613,490 B2
DATED : September 2, 2003
INVENTOR(S) : Satoshi Matsunnaga et al.

It is certified that error appears in the above-identified patent and that said Letters Patent is hereby corrected as shown below:

Column 38,
Lines 39 and 51, “higher” should read -- higher. --.

Column 39,
Lines 53 and 57, “resins” should read -- resin --.

Column 40,
Line 33, “image;;” should read -- image; --; and
Line 36, “without via” should read -- without --.

Signed and Sealed this

Sixth Day of January, 2004

JAMES E. ROGAN
*Director of the United States Patent and Trademark Office*